US006869507B2

(12) United States Patent
Frawley et al.

(10) Patent No.: US 6,869,507 B2
(45) Date of Patent: Mar. 22, 2005

(54) VARIABLE FREQUENCY DEWATERING ASSEMBLY

(75) Inventors: Thomas E. Frawley, Appleton, WI (US); Mark R. VanRens, DePere, WI (US); Patrick J. Theut, Tomahawk, WI (US); Alan Wouters, Appleton, WI (US)

(73) Assignee: Appleton International, Inc., Kimberly, WI (US)

( * ) Notice: Subject to any disclaimer, the term of this patent is extended or adjusted under 35 U.S.C. 154(b) by 63 days.

(21) Appl. No.: 10/430,872

(22) Filed: May 7, 2003

(65) Prior Publication Data

US 2003/0205348 A1 Nov. 6, 2003

Related U.S. Application Data

(63) Continuation of application No. 10/281,688, filed on Oct. 28, 2002, which is a continuation-in-part of application No. 09/972,144, filed on Oct. 5, 2001, now Pat. No. 6,471,829.

(60) Provisional application No. 60/238,930, filed on Oct. 10, 2000.

(51) Int. Cl.[7] ..... D21F 1/54

(52) U.S. Cl. ..... 162/352; 162/354; 162/374; 162/208; 162/211

(58) Field of Search ..... 162/208, 209, 162/211, 351–356, 374

(56) References Cited

U.S. PATENT DOCUMENTS

| | | | | |
|---|---|---|---|---|
| 3,027,941 A | | 4/1962 | Dunlap | 162/352 |
| 3,535,201 A | | 10/1970 | Reynolds et al. | 162/352 |
| 3,762,991 A | | 10/1973 | Justus | 162/352 |
| 3,934,996 A | | 1/1976 | Frank | 65/106 |
| 4,055,460 A | | 10/1977 | Buchanan | 162/209 |
| 4,123,322 A | | 10/1978 | Hoult | 162/352 |
| 4,162,937 A | | 7/1979 | Corbellini | 162/352 |
| 4,261,498 A | | 4/1981 | Short | 226/3 |
| 4,306,934 A | | 12/1981 | Seppanen | 162/209 |
| 4,321,108 A | * | 3/1982 | Goddard et al. | 162/272 |
| 4,331,511 A | | 5/1982 | Goddard et al. | 162/352 |
| 4,443,298 A | | 4/1984 | Thorp | 162/252 |
| 4,684,441 A | | 8/1987 | Ibrahim | 162/198 |
| 5,011,577 A | | 4/1991 | Hansen et al. | 162/352 |
| 5,074,964 A | | 12/1991 | Partanen | 162/203 |
| 5,089,090 A | * | 2/1992 | Hansen | 162/351 |
| 5,116,477 A | | 5/1992 | Bubik et al. | 162/352 |
| 5,169,500 A | | 12/1992 | Mejdell | 162/352 |

(List continued on next page.)

OTHER PUBLICATIONS

Bell, Norman E., Optimal Forming Zone Design is Key to Superior Sheet Characteristics, *Pulp & Paper*, pp. 157–164, Sep., 1992.

Paper Trade Associates, Wet–End Structures, http://paper-tradeassoc.com/p506.htm (2000).

PowerTrax,, Linear Systems & Components, http://www-.nookindustries.com/productsummary/powertrax.cfm.

(List continued on next page.)

*Primary Examiner*—Steven P. Griffin
*Assistant Examiner*—Eric Hug
(74) *Attorney, Agent, or Firm*—Whyte Hirschboeck Dudek SC

(57) ABSTRACT

A variable frequency foil (VFF) box assembly and mechanisms for moving individual foils/foil beams and individual foil beam sets relative to each other to adjust the frequency of a paper making machine, and method of use are provided. The VFF box assembly allows for continuously and uniformly adjusting the pitch distances of individual foils within foil sets over a finite range, and also adjusting the distance between foil sets during the continuous operation of a paper making machine. Also provided is a variable frequency assembly comprising a combination of dewatering elements such as one or more foil elements and table rolls, a multi-surfaced foil element, and/or an adjustable angle foil element.

41 Claims, 21 Drawing Sheets

U.S. PATENT DOCUMENTS

| | | | | | |
|---|---|---|---|---|---|
| 5,262,009 | A | | 11/1993 | Schiel et al. | 162/352 |
| 5,262,010 | A | | 11/1993 | Bubik et al. | 162/352 |
| 5,314,581 | A | | 5/1994 | Lin et al. | 162/263 |
| 5,421,961 | A | * | 6/1995 | Miller | 162/252 |
| 5,437,769 | A | | 8/1995 | Bando et al. | 162/301 |
| 5,486,270 | A | | 1/1996 | Schiel | 162/352 |
| 5,556,509 | A | | 9/1996 | Trokhan et al. | 162/111 |
| 5,599,426 | A | | 2/1997 | Hoffman | 162/60 |
| 5,630,910 | A | | 5/1997 | McPherson | 162/352 |
| 5,681,430 | A | | 10/1997 | Neun et al. | 162/355 |
| 5,922,173 | A | | 7/1999 | Neun et al. | 162/352 |
| 5,932,072 | A | | 8/1999 | Neun et al. | 162/352 |
| 6,274,002 | B1 | | 8/2001 | Rulis et al. | 162/352 |
| 6,372,093 | B1 | | 4/2002 | Brewer | 162/352 |
| 6,395,132 | B1 | | 5/2002 | Doelle et al. | 162/60 |
| 6,444,094 | B1 | | 9/2002 | Rulis et al. | 162/352 |
| 6,471,829 | B2 | | 10/2002 | Frawley, Jr. et al. | 162/352 |
| 2001/0025697 | A1 | | 10/2001 | Wildfong et al. | 162/301 |
| 2002/0060040 | A1 | | 5/2002 | Rulis et al. | 162/352 |
| 2002/0066546 | A1 | | 6/2002 | Forester | 162/352 |
| 2002/0069991 | A1 | | 6/2002 | Jewitt | 162/193 |
| 2002/0079076 | A1 | | 6/2002 | Bricco et al. | 162/203 |
| 2002/0121354 | A1 | | 9/2002 | Aidun | 162/216 |
| 2003/0116295 | A1 | | 6/2003 | Eames | 162/199 |
| 2003/0120373 | A1 | | 6/2003 | Eames | 700/128 |
| 2003/0183357 | A1 | * | 10/2003 | Sherril | 162/352 |

OTHER PUBLICATIONS

PowerTrac, Rolled & Precision Ground Ball Screws & Ball Splines, http://www.nookindustries.com/productsummary/powertrac.cfm.

Universal Thread Grinding Company, Precision Lead Screw Assemblies, http://www.thomasregister.com/olc/utg/plsa2.htm (2001).

GMS Ball Co. Ltd., GMS Ball Screw, http://www.gms-ball.co.uk.

Precision Screw Thread Corp., Lead Screws in Business Machine, http://www.precisionscrewthread.com/leadscrew.html (1999).

ActionJac™, Worm Gear Screw Jacks, http://www.nookindustries.com/productsummary/actionjac_gear.cfm.

ActionJac™, Electric Cylinder Actuators, http://www.nookindustries.com/productsummary/actionjac_cylinder.cfm.

BSA, Products, Linear Actuators, Ball Screws, Rails & Bearings, www.ballscrews.com/html/misc/products.html.

CoorsTek, *Hydro Foil Units*, 1 page, www.coorstek.com/ccprodserv/struc/pulpandpaper/hydrofoil.asp (printed Oct. 23, 2002).

Viking Foils, Inc., *Product Information—Viking Foils, Inc.*, 2 pages, www.vikingfoils.com/Pages/products.html (printed Oct. 10, 2002).

Giles, Arnold, *Proper Table Harmonics is Key to Improved Sheet Formation Program*, 5 pages (printed 10/02) http://www.weavexx.com.technical_library.htm http://www.weavexx.com/Files/PDF/Forming/Proper%20Table%20Harmonics%20is%20Key%20to%20Improved%20Sheet%20Formation.pdf.

*wet end ops, Wet End Papermaking Operations*, 2 pages, www.chem.vt.edu/chem–dept/helm/3434WOOD/notes3/formation.html (printed Oct. 10, 2002).

*Glossary of Papermaking Terms*, 10 pages, www.paperhall.org/info/glossary.html (printed Oct. 10, 2002).

Appleton International, Inc., *New Products*, 2 pages, www.appleton.intl.com/new–products.html (printed Sep. 20, 2002).

Appleton International, Inc., *Structural Drainage Elements*, 1 page, www.appleton–intl.com/sde.html (printed Oct. 10, 2002).

Appleton International, Inc., *Variable Frequency Foil systems patent pending*, 1 page, www.appleton–intl.com/vff.html (printed Sep. 20, 2002).

ForestSweden, *ForestSweden: Pulp and Paper Making*, 3 pages, www.skogssverige.se/MassaPapper/Faktaom/eng/massaopapptillv/paptillv.cfm (printed Oct. 10, 2002).

IBS Paper Performance Group, *IBS Paper Performance Group, T–Bars and height angle adjustment*, 1 page www.ibs–ceramics.com/redesign/english/products/dewatering/variolinesystem/tbars/tbars.htm (printed Oct. 23, 2002).

IBS Paper Performance Group, *IBS Paper Performance Group, Dewatering Technology—additional components*, 1 page www.ibs–ceramics.com/redesign/english/products/dewatering/standard.htm (printed Oct. 23, 2002).

IBS Paper Performance Group, *IBS Paper Performance Group, Dewatering Technology—standard elements*, 1 page www.ibs–ceramics.com/redesign/english/products/ dewatering/additional/additional.htm (printed Oct. 23, 2002).

IBS Paper Performance Group, *IBS Paper Performance Group, Single Doctors*, 1 page www.ibs–ceramics.com/redesign/english/products/doctor/single/single/htm (printed Oct. 23, 2002).

Viking Foils, Inc., *Viking Foils, Inc., Home Page*, 1 page www.vikingfoils.com (printed Oct. 10, 2002).

Weavexx, *Varizone, Adding Value through OpenDoor™, Introducing VARIZONE™ Formation Technology*, 3 pages (2002) www.weavexx.com/varizone.htm (printed Jan. 15, 2003).

Weavexx, *Varizone, Adding Value through OpenDoor™ Introducing VARIZONE™ Formation Technology*, 3 pages (2002) www.weavexx, varizone.htm (printed Dec. 9, 2002).

Weavexx, *Varizone™, Introducing VARIZONE™ Formation Technology*, 2 pages (2002).

Weavexx, *Weavexx Products Page, Products*, 1 page www.weavexx.com/products.htm, (printed Dec. 9, 2002) (2001).

Weavexx, *Equipment, Adding Value through OpenDoor™, Wet End Drainage Equipment*, 4 pages www.weavexx.com/equip.htm (printed Dec. 9, 2002).

*Weavexx introduces VARIZONE formation technology, Paper Industry*: Dec. 2002, at p. 27 (2002).

Weavexx, *Forming Boards*, 2 pages.

Eames, John, *Modified Foil Blade Design Improves Forming Table Drainage, Turbulence*, Weavexx, 4 pages http://www.weavexx.com/technical_library.htm http://www.weavexx.com/Files/PDF/Forming/Modified%20Foil%20Blade%20Design%20Design%20Improves%20Forming%20Table%20Drainage,%20Turbulence.pdf.

* cited by examiner

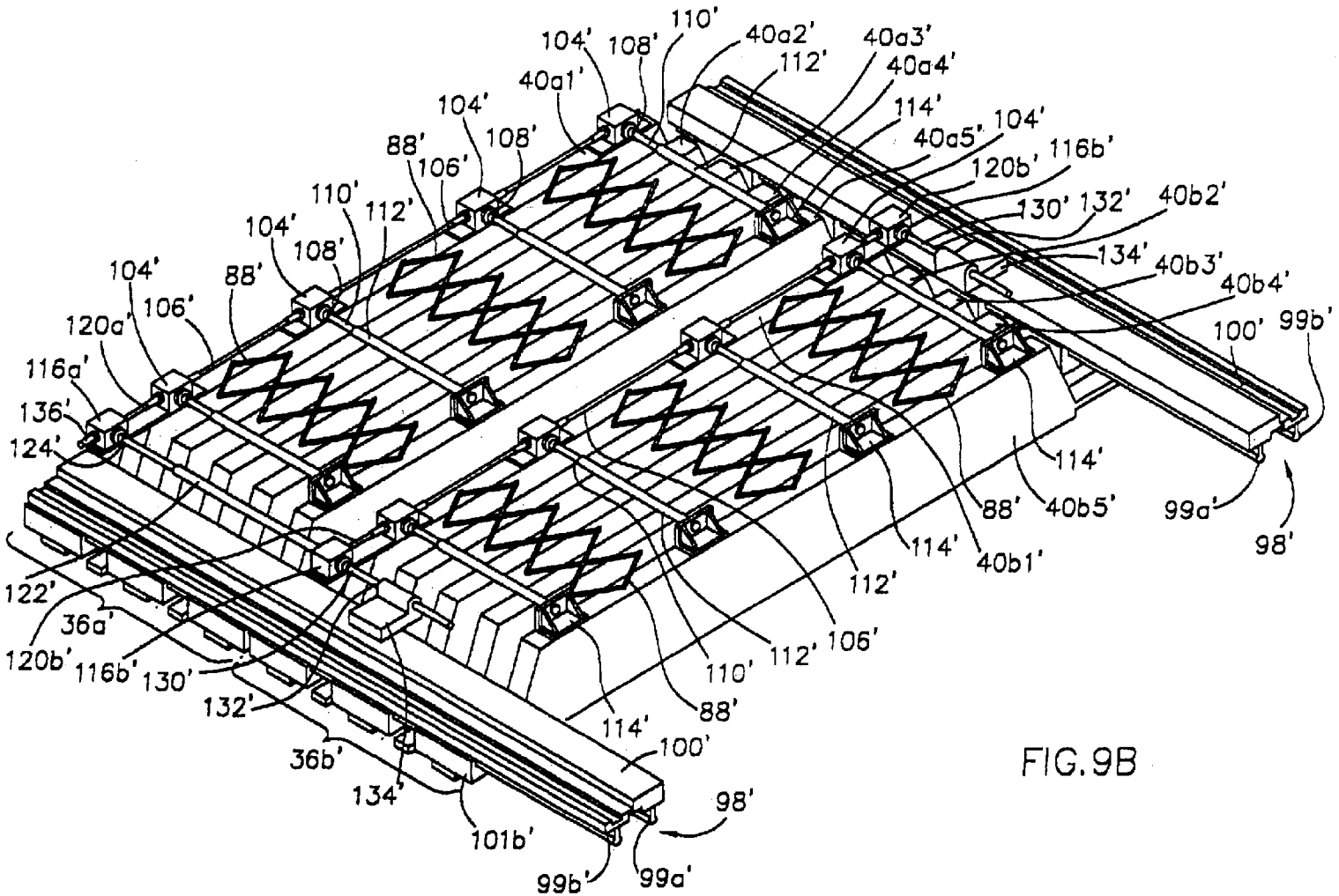
99b'
98'
99a'
40b4'
100'
40b2'
40b3'
134'
132'
130'
116b'
120b'
104'
40a5'
114'
40a4'
40a3'
40a2'
112'
110'
108'
40a1'
106'
88'
40b5'
40b1'
40b2'
40b3'
40b4'
40b5'
40a1'
40a2'
40a3'
40a4'
40a5'
120a'
116a'
136'
124'
122'
120b'
36a'
116b'
130'
132'
36b'
134'
101b'
99b'
99a'
98'
100'
114'
88'
110'
112'
106'
104'
108'
88'
106'
112'
110'
108'
104'
88'
106'
104'
120a'
116a'
136'
124'
122'
120b'
36a'
116b'
130'
132'
36b'
134'
101b'
99b'
99a'
98'
100'
114'
88'
110'
112'
106'
104'
108'
40a1'
104'
108'
88'
106'
112'
110'
108'
104'
88'
106'
104'
120a'
116a'
136'
124'
122'
120b'
36a'
116b'
130'
132'
36b'
134'
101b'
99b'
99a'
98'
100'
114'
88'
40b1'
114'
112'
106'
112'
110'
88'
40b5'
114'
40b4'
40b3'
40b2'
132'
130'
116b'
120b'
104'
40a5'
114'
40a4'
40a3'
40a2'
112'
110'
108'
104'
40a1'
108'
104'
106'
88'
112'
110'
108'
104'
88'
106'
104'
120a'
116a'
136'
124'
122'
120b'
36a'
116b'
130'
132'
36b'
134'
101b'
99b'
99a'
98'
100'
114'
88'
110'
112'
106'
104'
108'
40a1'
104'
108'
88'
106

VARIABLE FREQUENCY DEWATERING ASSEMBLY

CROSS-REFERENCE TO RELATED APPLICATIONS

This application is a continuation of U.S. patent application Ser. No. 10/281,688, filed Oct. 28, 2002, which is a continuation-in-part of U.S. patent application Ser. No. 09/972,144 (Publ. No. US2002/0067544), filed Oct. 5, 2001, now U.S. Pat. No. 6,471,829, issued Oct. 29, 2002, and claims the benefit of U.S. Provisional Application Ser. No. 60/238,930, filed Oct. 10, 2000.

FIELD OF THE INVENTION

The present invention relates to an apparatus and system for altering the frequency of a Fourdrinier table in the formation of a continuous web of paper or other material.

BACKGROUND OF THE INVENTION

In the manufacture of paper, a stock of fibers and mineral fillers suspended in water, is deposited onto the moving wire on the Fourdrinier table of a paper machine. An example of a conventional Fourdrinier table assembly 10 is shown in FIG. 1. The table 10 includes a head box 12 from which a stock suspension is deposited onto a continuously moving wire 14, a breast roll 16, forming unit 18, and a series of gravity foil boxes 20 and vacuum foil boxes 22, a dandy roll 24, a series of suction boxes 26, and a couch roll 28. As the stock suspension moves along the wire 14 and over the foil boxes 20, 22 and suction boxes 26, the water is removed to form a continuous web.

Many theories have been applied to enhance water removal and achieve proper fiber orientation and distribution to form the fiber sheet, but with varying degrees of success. In one practice, table rolls have been used to apply a vacuum pulse by drawing water from the undersurface of the wire, and then create a pressure pulse by pushing water through the fabric to agitate the stock suspension for proper fiber orientation. However, as production speeds increased and higher vacuum forces were applied, excessive jumping of the stock of the forming sheet occurred which adversely affected formation quality. With the development of hydrofoils, control of water removal and formation improved.

From 1960 to 1970, machines became faster and wider, and the gravity foil box was introduced. The device consisted of a bridge-like framework that spanned the table with "T" bars installed for the individual blades. Foil blades could be removed or added on the run, and the spacing of the "foil banks" was random at best. The concept of foil angle was then proposed and experimentation was performed to determine optimal foil blade angle and foil bank spacing on the machine, which are important to drainage and formation.

A subsequent development was the concept of table harmonics, an engineering principle stating that the energy contained within the stock at the exit of the head box can be amplified (for improved drainage and formation) by the spacing of the foils. The harmonic excitation of the stock can be further altered by placing foil banks at specific intervals along the table based on the tip-to-tip spacing of the foils within each bank. This principle gave rise to the practice of placing the start of a first foil bank in the vicinity of three to six feet from the exit of the head box. It was also learned that the ability to add or remove foils from a bank significantly impacted sheet properties. However, foil banks could not be moved while the machine was running due to the tremendous drag imparted onto the foils. In about 1978, the concept of table frequency was combined with table harmonics to maximize drainage and formation. It was discovered that packing a table with foils spaced an appropriate distance apart, and then removing the foils from the table in strategic locations, achieved the desired Fourdrinier frequency when operating at higher speeds, up to 3300 fpm and higher.

Another development included the introduction of an automated foil bank that varied the pitch of the foil blade (the variable angle foil) to impact drainage and formation. It was also determined that the best formation and drainage for any given table was a frequency between 55 Hz and 105 Hz. In addition, a foil bank system was introduced that could raise foils into the wire and/or drop them from contact with the wire, but only allowed the use of a finite number of frequencies (i.e., either 55 or 75 Hz) by the papermaker. This limits the success of the papermaker where another frequency (i.e., 61 Hz) would be optimal for formation and drainage.

The function of the Fourdrinier table is two-fold: (1) to de-water the stock utilizing the effects of both gravity and applied vacuum, and (2) to subject the stock to periodic excitation as the wire passes over a series of inverted continuous hydrofoil blades (foils) that extend transversely across the table in a cross machine direction, i.e., at a right angle to the direction in which the wire travels.

Traditionally, a Fourdrinier table include several sections of foil groupings, or sets, of approximately six foils each, that are mounted on individual foil support beam structures (i.e, T-bar mounts) spaced along the length of the table at set intervals to create a desired pulse frequency. The foil sets are normally affixed to a sub-structure of the table commonly referred to as a "box." An example of a conventional foil box 32, having four foils 34 is shown in FIG. 2. The direction of the movement of the wire (not shown) over the foils 34 is shown by arrow 30. The boxes are further sub-classified into either gravity boxes 20 or vacuum boxes 22 (FIG. 1). The first several foil sets aid in de-watering the stock under the influence of gravity. Further down the table as the water content of the stock decreases, a vacuum is applied from beneath the wire to facilitate the de-watering process.

The foils aid in the de-watering process and also impart a pressure impulse to the stock suspension. The impulses serve to keep the fibers and fillers in suspension during the de-watering process yielding a paper stock of uniform consistency. A single pulse is not adequate to control the stock on the Fourdrinier table. Rather, a series of pulses is generated and repeated at a standard interval.

The frequency of these impulses is referred to as the Fourdrinier frequency, which is defined as the velocity of the wire (in inches-per-second) divided by the pitch distance between the foils (in inches). It is well known to those versed in the art/science of papermaking that the frequency of these impulses has a dramatic effect upon the formation of the paper fibers. Under most circumstances, acceptable formation occurs at a Fourdrinier frequency between about 55 hertz and about 90 hertz. However, the current state of the art/science of paper formation relies upon the strategic use of conventional foil blades, multi-pulse foils, and/or foil boards that compromise effective stock de-watering with appropriate stock excitation frequencies.

SUMMARY OF THE INVENTION

The present invention provides variable frequency foil (VFF) box assemblies and mechanisms for moving individual foils/foil beams and individual foil beam sets relative to each other to adjust the frequency of a paper making machine independent of the wire speed. The invention allows for continuously and uniformly adjusting the pitch distances of individual foils within foil sets over a finite range, and also adjusting the distance between foil sets during the operation of a paper making machine. The invention also provides variable frequency dewatering assemblies that comprise various dewatering elements such as a foil beam and table roll in combination, and assemblies that incorporate multi-surface foil elements and adjustable angle foil blades.

In one aspect, the invention provides a foil beam assembly. In one embodiment, the foil beam assembly comprises at least a first and a second foil beam set, each foil beam set comprising a leading foil beam, a trailing foil beam, and at least one intermediate foil beam disposed therebetween, and a mechanism to laterally move the foil beams and the foil sets relative to each other. The mechanism is connected to each of the foil beams and to the first and second foil beam set. The mechanism is operable to laterally move the foil beams to alter the pitch distance such that each of the foil beams are spaced apart by a standard interval, and to laterally move at least one of the foil beam sets to alter the distance therebetween such that the foil beam sets are spaced apart by an integer multiple of the standard interval.

In one embodiment of the foil beam assembly, the mechanism can comprise a mating screw and nut assembly affixed to a first foil beam and an adjacent second foil beam, and in rotatable contact with a gear mounted on a shaft, whereby rotating the shaft causes lateral movement of at least the second foil beam to alter the pitch distance between the first and second foil beams. In another embodiment, the mechanism of the foil beam assembly comprises a hydraulic or pneumatic device mounted on the first and second foil beams and operable to laterally move at least the second foil beam relative to the first foil beam. In another embodiment of the foil beam assembly, the mechanism can comprise an activating screw and nut assembly affixed to the second foil beam and oriented perpendicular to the foil beams, the activating screw connected to an actuating device operable to move the activating screw to laterally move the second foil beam relative to the first foil beam. In yet another embodiment, the mechanism of the foil beam assembly can comprise nut members mounted on a surface of the first and second foil beams, and activating screw members engaged through the nut members and extending perpendicular to the foil beams, the activating screw members connected to actuators comprising a worm/gear assembly mounted on a drive shaft, wherein movement of the actuators move the activating screw members which laterally move at least the second foil beam relative to the first foil beam. Yet another embodiment of a mechanism for use in the foil beam assembly comprises a pantograph assembly connected to the first and second foil beams, wherein extension and retraction of the pantograph moves at least the second foil beam relative to the first foil beam to alter the pitch distance therebetween. A further embodiment of the mechanism of the foil beam assembly comprises a telescoping shaft assembly.

In another aspect, the invention provides a method of varying the frequency of a foil beam set. In one embodiment, the method comprises the steps of providing at least a first and second foil beam set, each set comprising two or more foil beams mounted on a support structure, and a mechanism interconnecting the foil beams and the foil beam sets, the mechanism structured to laterally move the foil beams relative to each other and to laterally move the foil beam sets relative to each other; and actuating the mechanism to laterally move the foil beams to alter the distance therebetween and maintain the foil beams at a distance X relative to each other, and to laterally move the foil beam sets relative to each other to a distance as an integer multiple of the distance X, wherein the combined frequency of the foil beam sets is maintained at about 50 to about 90 hertz.

In another aspect, the invention provides an assembly for dewatering a suspension in a papermaking apparatus. In one embodiment, the assembly comprises first and second sets of dewatering elements mounted on a support structure, at least one set including at least one foil element and at least one table roll, and an actuating mechanism interconnecting the dewatering elements and the sets and operable to laterally move and space apart the dewatering elements by a standard interval, and to laterally move at least one of the sets to space apart the sets by an integer multiple of the standard interval. In a method of varying the frequency of a set of dewatering elements, the actuating mechanism is activated to laterally move the dewatering elements relative to each other to a distance X and to laterally move the sets relative to each other to a distance as an integer multiple of the distance X.

In another embodiment of a foil assembly according to the invention, the assembly comprises at least one multi-surfaced foil element. In one embodiment, the multi-surfaced foil element comprises a unitary structure having two wire-contacting surfaces spaced apart by the standard interval X with a suction-forming section and a drainage section therebetween. Such a foil element is useful to achieve a pitch distance between wire contact surfaces of about 1 inch to up to 2-½ inches, although higher pitch distances can be used if desired. In an embodiment of a VF assembly, the assembly can comprise a multi-surfaced foil element in combination with a foil having a single wire contacting surface or other foil element, and/or a table roll or other dewatering element.

BRIEF DESCRIPTION OF THE DRAWINGS

Preferred embodiments of the invention are described below with reference to the following accompanying drawings, which are for illustrative purposes only. Throughout the following views, the reference numerals will be used in the drawings, and the same reference numerals will be used throughout the several views and in the description to indicate same or like parts.

FIG. 8A is a top perspective view of the variable frequency foil box. FIG. 8B is a bottom plan view of the variable frequency box of FIG. 8A, taken along lines A—A, and showing the attachment of the foil support beams to the center points of the underlying pantograph assembly. FIG. 8C is a side elevational view of the variable frequency box of FIG. 8B, taken along lines B—B.

FIGS. 9A–9B are top and bottom perspective views, respectively, of another embodiment of a variable frequency foil (VFF) box according to the invention assembled with a second set of foils, showing the leading and trailing foil beams of each set mounted on linear rails, and utilizing pantograph assemblies, right-angle gearboxes and lead screw assemblies to move the foil support beams.

DETAILED DESCRIPTION OF THE INVENTION

The present invention relates to mechanisms and methods for varying the frequency of a Fourdrinier table, independent of the wire speed, by continuously and uniformly adjusting the pitch distances of individual foils within foil sets over a finite range, and also adjusting the distance between foil sets (boxes). The mechanisms of the invention can be used in gravity box sections of the infeed end of a paper machine Fourdrinier table, among other applications. The invention will be described generally with reference to the drawings for the purpose of illustrating the present preferred embodiments only and not for purposes of limiting the same.

Figure 1:
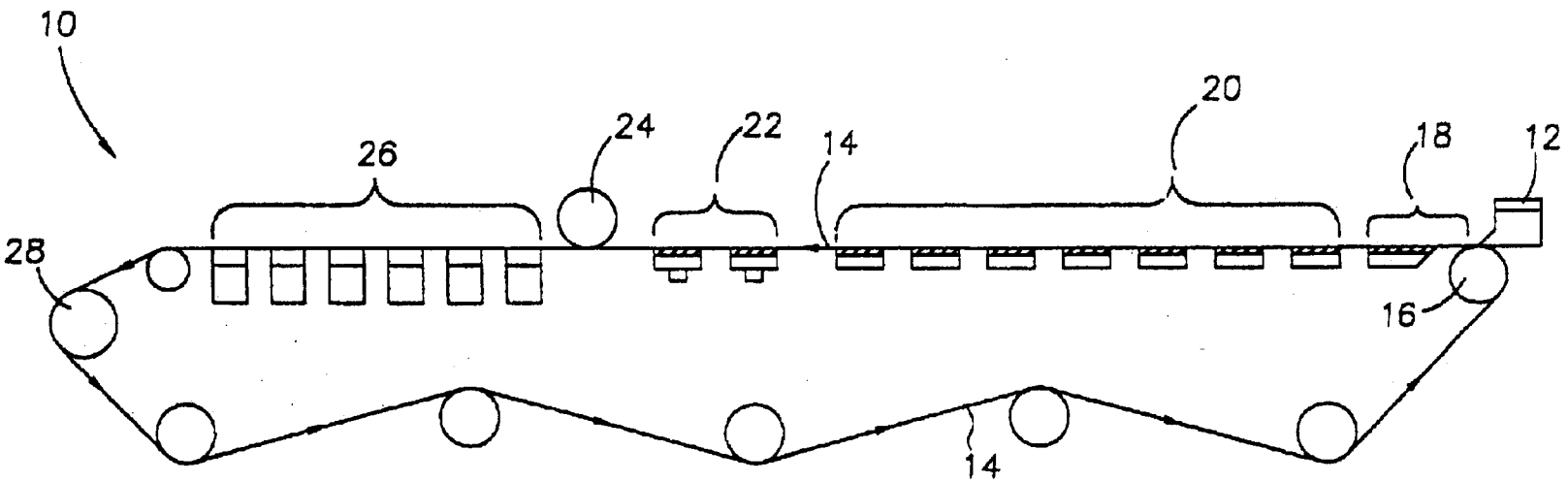
FIG. 1 PRIOR ART
FIG. 1 is an illustration of a conventional Fourdrinier table assembly.
Figure 2:
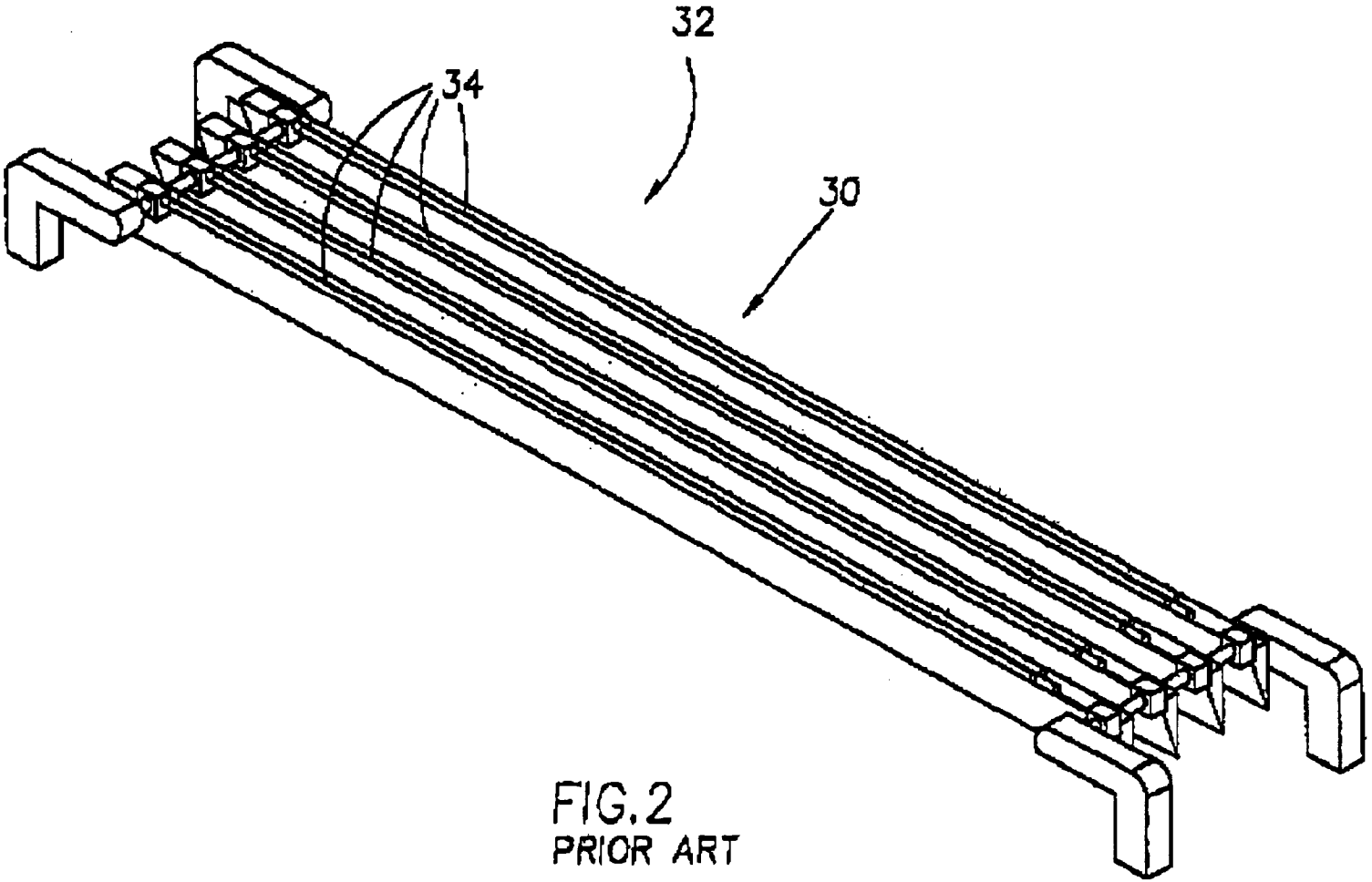
FIG. 2 PRIOR ART
FIG. 2 is a perspective view of a conventional foil box having four foils.
Figure 3:
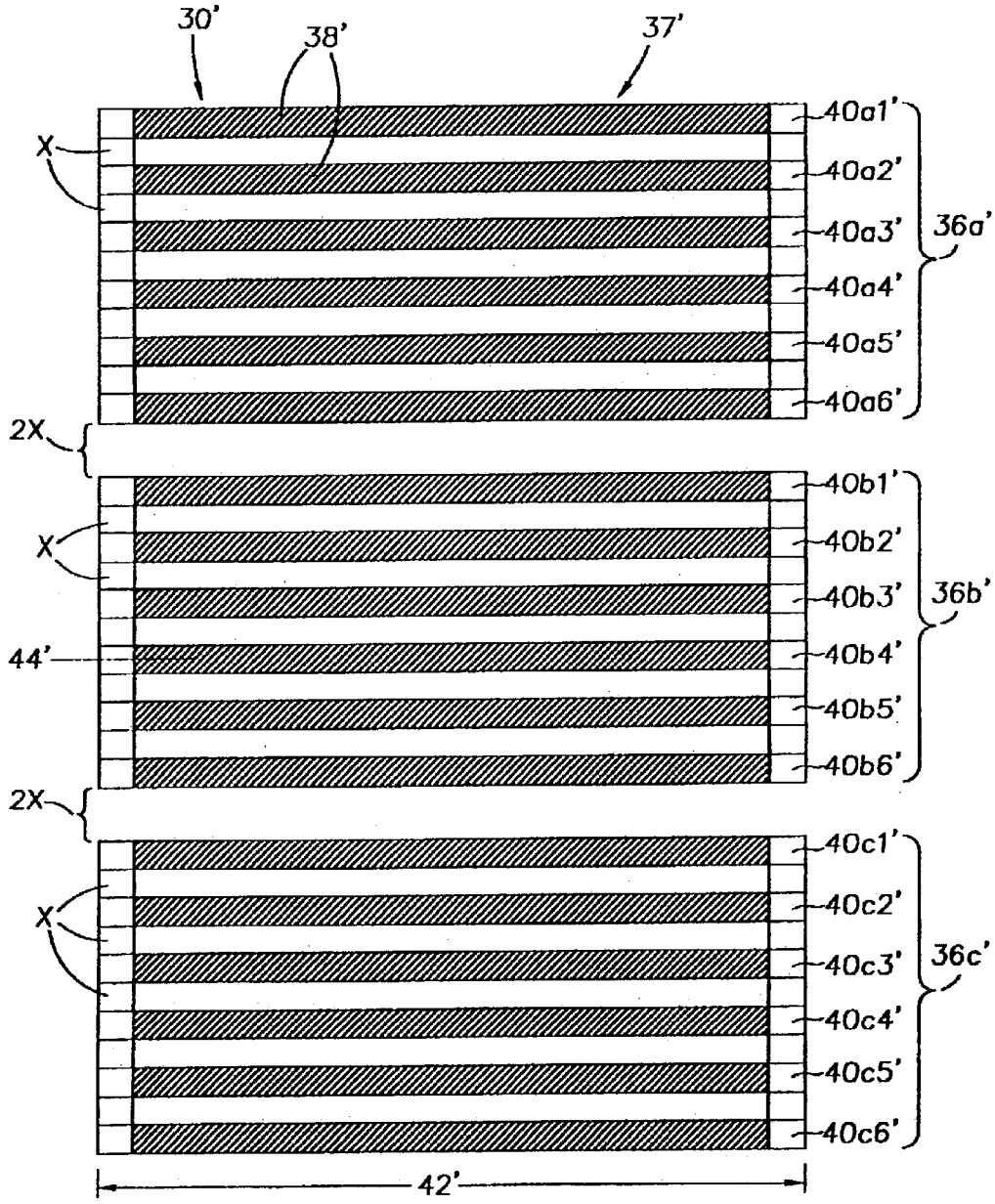
FIG. 3 is a schematic top plan view of an embodiment of an assembly of variable frequency foil boxes according to the invention comprising a series of three foil sets (boxes), each foil set having six foils.

An assembly 37' comprising three variable frequency foil (VFF) boxes ("foil sets") 36*a*', 36*b*', 36*c*' for use in a Fourdrinier table, is illustrated in FIG. 3. As typical, each VFF foil set 36*a*'–36*c*' incorporates up to six foils 38' (38'*a–c*, 1–6) affixed to individual foil support beam structures 40' (40'*a–c*, 1–6), although an individual foil set can comprise more or less foils as desired. The width 42' of the foil boxes 36*a*'–36*c*' corresponds to the width of the paper making machine. The foil support beams 40' are mounted so as to prevent movement along their respective centerlines 44', and to provide free movement along an axis perpendicular to their respective centerlines.

Utilizing a mechanism according to the invention, the frequency of an individual foil box or set 36*a*'–36*c*' ("box frequency") is infinitely adjustable over a finite range by altering the pitch distance between the foil blades 38' within a foil set such that all the foils remain substantially equally spaced at a distance "X" throughout the adjustment range. According to the invention, in addition to maintaining a spacing of "X" between the foils/foil beams within a single foil set 36*a*'–6*c*' the relative distance between adjacent foil sets is also maintained at a standard interval (e.g., the foil spacing distance "X") or an integer multiple of that standard interval to sustain the desired frequency of the Fourdrinier table as a whole ("table frequency" or "Fourdrinier frequency"). For example, referring to foil sets 36*a*' and 36*b*', if the standard interval between foil support beams 40*a*1'–40*a*6' is X-inch (e.g., 5¼-inch), then the distance between the last (trailing) foil beam 40*a*6' on the first foil set 36*a*' and the leading foil beam 40*b*1' on the next (second) foil set 36*b*' would be either 1X, 2X, 3X-inch, etc. (5¼, 10½, 15¾-inch, etc.), and the distance between the last (trailing) foil beam 40*a*6' on the second foil set 36*a*' to the leading foil beam 40*c*1' on the next (third) foil set 36*c*' would also be either 1X, 2X, 3X-inch etc. (5¼, 10½, 15¼-inch, etc.), and so forth. This is accomplished by altering the distances between adjacent foil sets (36*a*' to 36*b*', 36*b*' to 36*c*') utilizing a mechanism according to the invention. As depicted in FIG. 3, the standard interval between foils is "X", and the distance between foil sets is "2X".

Figure 4:
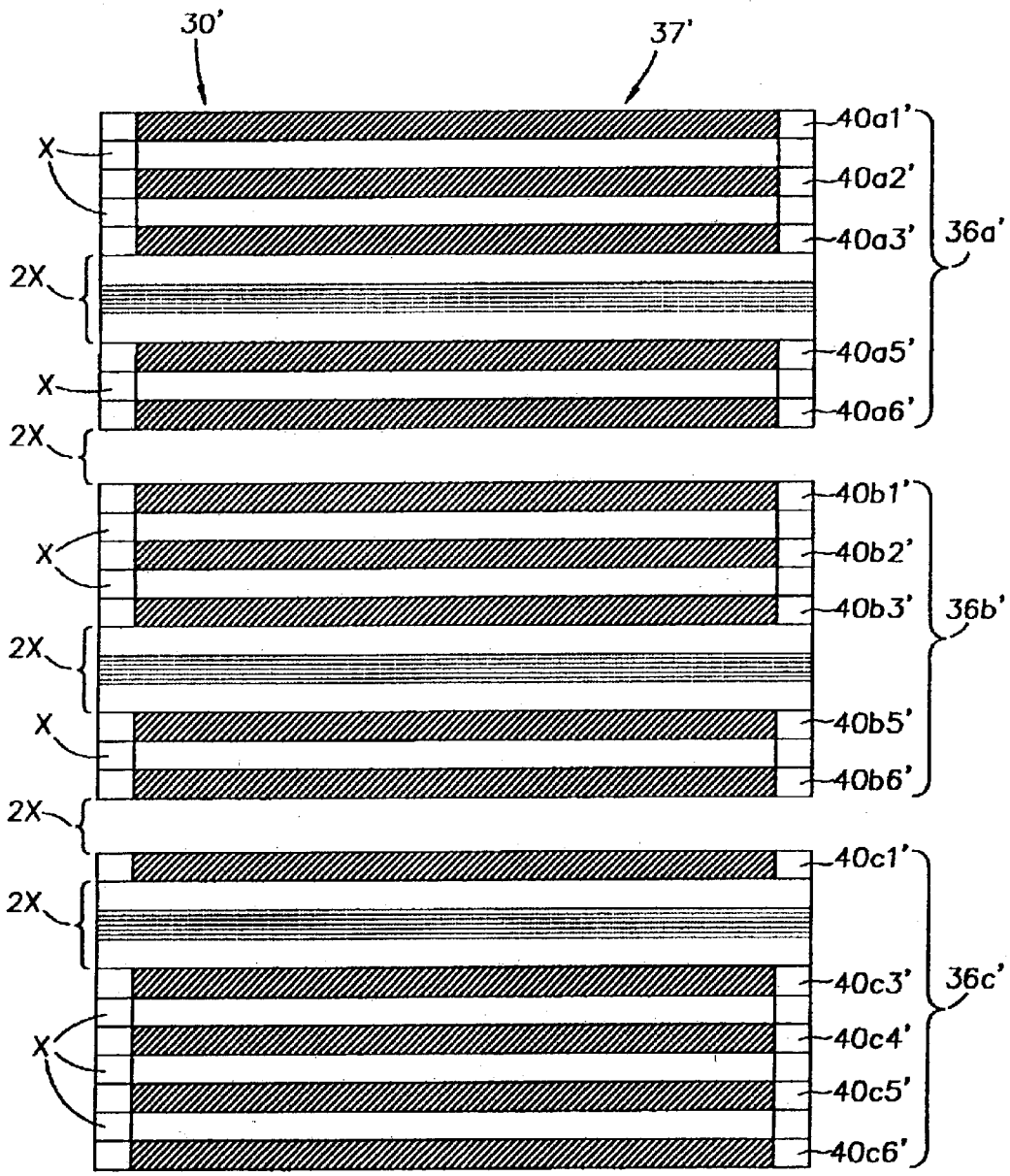
FIG. 4 is a schematic top plan view of the variable frequency foil box assembly of FIG. 3, showing foils having been removed from two foil sets.

In addition, one or more of the foil support beams 40' within a foil set can be removed to effect desirable changes to the rate at which water is drained from the stock. For example, as depicted in FIG. 4, the fourth foil beam 40*a*4' has been removed from the first foil set 36*a*', and foil beams 40*b*4' and 40*c*2' have been removed from the second and third foil sets 36*b*', 36*c*', respectively. Removal of foil beams preferably does not alter the Fourdrinier frequency once established. Removal of every other foil beam in a foil set results in a 2X spacing between foil beams and a frequency that is one-half of that achievable with a foil set in which all six foil beams 40' are provided at a spacing of "X".

The table frequency or Fourdrinier frequency is altered as a function of wire speed and foil pitch distance according to the following formula:

$$\frac{\text{Velocity of the wire (inch/second)}}{\text{Pitch distance between foils (inches)}}$$

Table 1 shows the Fourdrinier frequencies over a range of wire speeds and foil pitch distances, which is preferably about 50 hertz to about 90 hertz.

Fourdrinier Frequency as a Function of Wire Speed and Foil Pitch Distance

| | | Foil Pitch | | | | | | | | | | | | | | | | | | | | |
|---|---|---|---|---|---|---|---|---|---|---|---|---|---|---|---|---|---|---|---|---|---|---|
| ft/min | in/sec | 1.00 | 1.25 | 1.50 | 1.75 | 2.00 | 2.25 | 2.50 | 2.75 | 3.00 | 3.25 | 3.50 | 3.75 | 4.00 | 4.25 | 4.50 | 4.75 | 5.00 | 5.25 | 5.50 | 5.75 | 6.00 |
| 500.00 | 100.00 | 100.00 | 80.00 | 66.67 | 57.14 | 50.00 | 44.44 | 40.00 | 36.36 | 33.33 | 30.77 | 28.57 | 26.67 | 25.00 | 23.53 | 22.22 | 21.05 | 20.00 | 19.05 | 18.18 | 17.39 | 16.67 |
| 600.00 | 120.00 | 120.00 | 96.00 | 80.00 | 68.57 | 60.00 | 53.33 | 48.00 | 43.64 | 40.00 | 36.92 | 34.29 | 32.00 | 30.00 | 28.24 | 26.67 | 25.26 | 24.00 | 22.86 | 21.82 | 20.87 | 20.00 |
| 700.00 | 140.00 | 140.00 | 112.00 | 93.33 | 80.00 | 70.00 | 62.22 | 56.00 | 50.91 | 46.67 | 43.08 | 40.00 | 37.33 | 35.00 | 32.94 | 31.11 | 29.47 | 28.00 | 26.67 | 25.45 | 24.35 | 23.33 |
| 800.00 | 160.00 | 160.00 | 128.00 | 106.67 | 91.43 | 80.00 | 71.11 | 64.00 | 58.18 | 53.33 | 49.23 | 45.71 | 42.67 | 40.00 | 37.65 | 35.56 | 33.68 | 32.00 | 30.48 | 29.09 | 27.83 | 26.67 |
| 900.00 | 180.00 | 180.00 | 144.00 | 120.00 | 102.86 | 90.00 | 80.00 | 72.00 | 65.45 | 60.00 | 55.38 | 51.43 | 48.00 | 45.00 | 42.35 | 40.00 | 37.89 | 36.00 | 34.29 | 32.73 | 31.30 | 30.00 |
| 1000.00 | 200.00 | 200.00 | 160.00 | 133.33 | 114.29 | 100.00 | 88.89 | 80.00 | 72.73 | 66.67 | 61.54 | 57.14 | 53.33 | 50.00 | 47.06 | 44.44 | 42.11 | 40.00 | 38.10 | 36.36 | 34.78 | 33.33 |
| 1100.00 | 220.00 | 220.00 | 176.00 | 146.67 | 125.71 | 110.00 | 97.78 | 88.00 | 80.00 | 73.33 | 67.69 | 62.86 | 58.67 | 55.00 | 51.76 | 48.89 | 46.32 | 44.00 | 41.90 | 40.00 | 38.26 | 36.67 |
| 1200.00 | 240.00 | 240.00 | 192.00 | 160.00 | 137.14 | 120.00 | 106.67 | 95.00 | 87.27 | 80.00 | 73.85 | 68.57 | 64.00 | 60.00 | 56.47 | 53.33 | 50.53 | 48.00 | 45.71 | 43.64 | 41.74 | 40.00 |
| 1300.00 | 260.00 | 260.00 | 208.00 | 173.33 | 148.57 | 130.00 | 115.56 | 104.00 | 94.55 | 86.67 | 80.00 | 74.29 | 69.33 | 65.00 | 61.18 | 57.78 | 54.74 | 52.00 | 49.52 | 47.27 | 45.22 | 43.33 |
| 1400.00 | 280.00 | 280.00 | 224.00 | 186.67 | 160.00 | 140.00 | 124.44 | 112.00 | 101.82 | 93.33 | 86.15 | 80.00 | 74.67 | 70.00 | 65.88 | 62.22 | 58.95 | 56.00 | 53.33 | 50.91 | 48.70 | 46.67 |
| 1500.00 | 300.00 | 300.00 | 240.00 | 200.00 | 171.43 | 150.00 | 133.33 | 120.00 | 109.09 | 100.00 | 92.31 | 85.71 | 80.00 | 75.00 | 70.59 | 66.67 | 63.16 | 60.00 | 57.14 | 54.55 | 52.17 | 50.00 |
| 1600.00 | 320.00 | 320.00 | 256.00 | 213.33 | 182.86 | 160.00 | 142.22 | 128.00 | 116.36 | 106.67 | 98.46 | 91.43 | 85.33 | 80.00 | 75.29 | 71.11 | 67.37 | 64.00 | 60.95 | 58.18 | 55.65 | 53.33 |
| 1700.00 | 340.00 | 340.00 | 272.00 | 226.67 | 194.29 | 170.00 | 151.11 | 136.00 | 123.64 | 113.33 | 104.62 | 97.14 | 90.67 | 85.00 | 80.00 | 75.56 | 71.58 | 68.00 | 64.76 | 61.82 | 59.13 | 56.67 |
| 1800.00 | 360.00 | 360.00 | 288.00 | 240.00 | 205.71 | 180.00 | 160.00 | 144.00 | 130.91 | 120.00 | 110.77 | 102.86 | 96.00 | 90.00 | 84.71 | 80.00 | 75.79 | 72.00 | 68.57 | 65.45 | 62.61 | 60.00 |
| 1900.00 | 380.00 | 380.00 | 304.00 | 253.33 | 217.14 | 190.00 | 168.89 | 152.00 | 138.18 | 126.67 | 116.92 | 108.57 | 101.33 | 95.00 | 89.41 | 84.44 | 80.00 | 76.00 | 72.38 | 69.09 | 66.09 | 63.33 |
| 2000.00 | 400.00 | 400.00 | 320.00 | 266.67 | 228.57 | 200.00 | 177.78 | 160.00 | 145.45 | 133.33 | 123.08 | 114.29 | 106.67 | 100.00 | 94.12 | 88.89 | 84.21 | 80.00 | 76.19 | 72.73 | 69.57 | 66.67 |
| 2100.00 | 420.00 | 420.00 | 336.00 | 280.00 | 240.00 | 210.00 | 186.67 | 168.00 | 152.73 | 140.00 | 129.23 | 120.00 | 112.00 | 105.00 | 98.82 | 93.33 | 88.42 | 84.00 | 80.00 | 76.36 | 73.04 | 70.00 |
| 2200.00 | 440.00 | 440.00 | 352.00 | 293.33 | 251.43 | 220.00 | 195.56 | 176.00 | 160.00 | 146.67 | 135.38 | 125.71 | 117.33 | 110.00 | 103.53 | 97.78 | 92.63 | 88.00 | 83.81 | 80.00 | 76.52 | 73.33 |
| 2300.00 | 460.00 | 460.00 | 368.00 | 306.67 | 262.86 | 230.00 | 204.44 | 184.00 | 167.27 | 153.33 | 141.54 | 131.43 | 122.67 | 115.00 | 108.24 | 102.22 | 96.84 | 92.00 | 87.62 | 83.64 | 80.00 | 76.67 |
| 2400.00 | 480.00 | 480.00 | 384.00 | 320.00 | 274.29 | 240.00 | 213.33 | 192.00 | 174.55 | 160.00 | 147.69 | 137.14 | 128.00 | 120.00 | 112.94 | 106.67 | 101.05 | 96.00 | 91.43 | 87.27 | 83.48 | 80.00 |
| 2500.00 | 500.00 | 500.00 | 400.00 | 333.33 | 285.71 | 250.00 | 222.22 | 200.00 | 181.82 | 166.67 | 153.85 | 142.86 | 133.33 | 125.00 | 117.65 | 111.11 | 105.26 | 100.00 | 95.24 | 90.91 | 86.96 | 83.33 |
| 2600.00 | 520.00 | 520.00 | 416.00 | 346.67 | 297.14 | 260.00 | 231.11 | 208.00 | 189.09 | 173.33 | 160.00 | 148.57 | 138.67 | 130.00 | 122.35 | 115.56 | 109.47 | 104.00 | 99.05 | 94.55 | 90.43 | 86.67 |
| 2700.00 | 540.00 | 540.00 | 432.00 | 360.00 | 308.57 | 270.00 | 240.00 | 216.00 | 196.36 | 180.00 | 166.15 | 154.29 | 144.00 | 135.00 | 127.06 | 120.00 | 113.68 | 108.00 | 102.86 | 98.18 | 93.91 | 90.00 |
| 2800.00 | 560.00 | 560.00 | 448.00 | 373.33 | 320.00 | 280.00 | 248.89 | 224.00 | 203.64 | 186.67 | 172.31 | 160.00 | 149.33 | 140.00 | 131.76 | 124.44 | 117.89 | 112.00 | 106.67 | 101.82 | 97.39 | 93.33 |
| 2900.00 | 580.00 | 580.00 | 464.00 | 386.67 | 331.43 | 290.00 | 257.78 | 232.00 | 210.91 | 193.33 | 178.46 | 165.71 | 154.67 | 145.00 | 136.47 | 128.89 | 122.11 | 116.00 | 110.48 | 105.45 | 100.87 | 96.67 |
| 3000.00 | 600.00 | 600.00 | 480.00 | 400.00 | 342.86 | 300.00 | 266.67 | 240.00 | 218.18 | 200.00 | 184.62 | 171.43 | 160.00 | 150.00 | 141.18 | 133.33 | 126.32 | 120.00 | 114.29 | 109.09 | 104.35 | 100.00 |

-continued

Fourdrinier Frequency as a Function of Wire Speed and Foil Pitch Distance

| | | | | | | | | | | | | | | | | | | | | | | |
|---|---|---|---|---|---|---|---|---|---|---|---|---|---|---|---|---|---|---|---|---|---|---|
| 3100.00 | 620.00 | 620.00 | 496.00 | 413.33 | 354.29 | 310.00 | 275.56 | 248.00 | 225.45 | 206.67 | 190.77 | 177.14 | 165.33 | 155.00 | 145.88 | 137.78 | 130.53 | 124.00 | 118.10 | 112.73 | 107.83 | 103.33 |
| 3200.00 | 640.00 | 640.00 | 512.00 | 426.67 | 365.71 | 320.00 | 284.44 | 256.00 | 232.73 | 213.33 | 196.92 | 182.86 | 170.67 | 160.00 | 150.69 | 142.22 | 134.74 | 128.00 | 121.90 | 116.36 | 111.30 | 106.67 |
| 3300.00 | 660.00 | 660.00 | 528.00 | 440.00 | 377.14 | 330.00 | 293.33 | 264.00 | 240.00 | 220.00 | 203.08 | 188.57 | 176.00 | 165.00 | 155.29 | 146.67 | 138.95 | 132.00 | 125.71 | 120.00 | 114.78 | 110.00 |
| 3400.00 | 680.00 | 680.00 | 544.00 | 453.33 | 368.57 | 340.00 | 302.22 | 272.00 | 247.27 | 266.67 | 209.23 | 194.29 | 181.33 | 170.00 | 180.00 | 151.11 | 143.16 | 136.00 | 129.52 | 123.64 | 118.26 | 113.33 |
| 3500.00 | 700.00 | 700.00 | 560.00 | 466.67 | 400.00 | 350.00 | 311.11 | 280.00 | 254.55 | 233.33 | 215.38 | 200.00 | 186.67 | 175.00 | 164.71 | 155.56 | 147.37 | 140.00 | 133.33 | 127.27 | 121.74 | 116.67 |
| 3600.00 | 720.00 | 720.00 | 576.00 | 480.00 | 411.43 | 360.00 | 320.00 | 288.00 | 261.82 | 240.00 | 221.54 | 205.71 | 192.00 | 180.00 | 169.41 | 160.00 | 151.58 | 144.00 | 137.14 | 130.91 | 125.22 | 120.00 |
| 3700.00 | 740.00 | 740.00 | 592.00 | 493.33 | 422.86 | 370.00 | 328.89 | 296.00 | 269.09 | 246.67 | 227.69 | 211.43 | 197.33 | 185.00 | 174.12 | 164.44 | 155.79 | 148.00 | 140.95 | 134.55 | 128.70 | 123.33 |
| 3800.00 | 760.00 | 760.00 | 608.00 | 506.67 | 434.29 | 380.00 | 337.78 | 304.00 | 276.36 | 253.33 | 233.85 | 217.14 | 202.67 | 190.00 | 178.82 | 168.89 | 160.00 | 152.00 | 144.76 | 138.18 | 132.17 | 126.67 |
| 3900.00 | 780.00 | 780.00 | 624.00 | 520.00 | 445.71 | 390.00 | 346.67 | 312.00 | 283.64 | 260.00 | 240.00 | 222.86 | 208.00 | 195.00 | 183.53 | 173.33 | 164.21 | 156.00 | 148.57 | 141.82 | 135.65 | 130.00 |
| 4000.00 | 800.00 | 800.00 | 640.00 | 533.33 | 457.14 | 400.00 | 355.56 | 320.00 | 290.91 | 266.67 | 246.15 | 228.57 | 213.33 | 200.00 | 188.24 | 177.78 | 168.42 | 160.00 | 152.36 | 145.45 | 139.13 | 133.33 |
| 4100.00 | 820.00 | 820.00 | 656.00 | 546.67 | 468.57 | 410.00 | 364.44 | 328.00 | 298.18 | 273.33 | 252.31 | 234.29 | 218.67 | 205.00 | 192.94 | 182.22 | 172.63 | 164.00 | 156.19 | 149.09 | 142.61 | 136.67 |
| 4200.00 | 840.00 | 840.00 | 672.00 | 560.00 | 480.00 | 420.00 | 373.33 | 336.00 | 305.45 | 280.00 | 258.46 | 240.00 | 224.00 | 210.00 | 197.65 | 186.67 | 176.84 | 168.00 | 160.00 | 152.73 | 146.09 | 140.00 |
| 4300.00 | 860.00 | 860.00 | 688.00 | 573.33 | 491.43 | 430.00 | 382.22 | 344.00 | 312.73 | 286.67 | 264.62 | 245.71 | 229.33 | 215.00 | 202.35 | 191.11 | 181.05 | 172.00 | 163.81 | 156.36 | 149.57 | 143.33 |
| 4400.00 | 880.00 | 880.00 | 704.00 | 586.67 | 502.86 | 440.00 | 391.11 | 352.00 | 320.00 | 293.33 | 270.77 | 251.43 | 234.67 | 220.00 | 207.06 | 195.56 | 185.26 | 176.00 | 167.62 | 160.00 | 153.04 | 146.67 |
| 4500.00 | 900.00 | 900.00 | 720.00 | 600.00 | 514.29 | 450.00 | 400.00 | 360.00 | 327.27 | 300.00 | 276.92 | 257.14 | 240.00 | 225.00 | 211.76 | 200.00 | 189.47 | 180.00 | 171.43 | 163.64 | 156.52 | 150.00 |

Foil Pitch

| ft/min | in/sec | | 6.25 | 6.50 | 6.75 | 7.00 | 7.25 | 7.50 | 7.75 | 8.00 | 8.25 | 8.50 | 8.75 | 9.00 | 9.25 | 9.50 | 9.75 | 10.00 | 10.25 | 10.50 | 10.75 | 11.00 | 11.25 | 11.50 | 11.75 | 12.00 |
|---|---|---|---|---|---|---|---|---|---|---|---|---|---|---|---|---|---|---|---|---|---|---|---|---|---|---|
| 500.00 | 100.00 | 100.00 | 16.00 | 15.38 | 14.81 | 14.29 | 13.79 | 13.33 | 12.90 | 12.50 | 12.12 | 11.76 | 11.43 | 11.11 | 10.81 | 10.53 | 10.26 | 10.00 | 7.96 | 9.52 | 9.30 | 9.09 | 8.89 | 8.70 | 8.51 | 8.33 |
| 600.00 | 120.00 | 120.00 | 19.20 | 18.45 | 17.78 | 17.14 | 16.55 | 16.00 | 15.48 | 15.00 | 14.55 | 14.12 | 13.71 | 13.33 | 12.97 | 12.63 | 12.31 | 12.00 | 11.71 | 11.43 | 11.16 | 10.91 | 10.67 | 10.43 | 10.21 | 10.00 |
| 700.00 | 140.00 | 140.00 | 22.40 | 21.54 | 20.74 | 20.00 | 19.31 | 18.67 | 18.06 | 17.50 | 16.97 | 16.47 | 16.00 | 15.56 | 15.14 | 14.74 | 14.36 | 14.00 | 13.66 | 13.33 | 13.02 | 12.73 | 12.44 | 12.17 | 11.91 | 11.67 |
| 800.00 | 160.00 | 160.00 | 25.60 | 24.52 | 23.70 | 22.86 | 22.07 | 21.33 | 20.55 | 20.00 | 19.39 | 18.82 | 18.29 | 17.78 | 17.30 | 16.84 | 16.41 | 16.00 | 15.61 | 15.24 | 14.88 | 14.55 | 14.22 | 13.91 | 13.62 | 13.33 |
| 900.00 | 180.00 | 180.00 | 28.80 | 27.69 | 26.67 | 25.71 | 24.83 | 24.00 | 23.23 | 22.50 | 21.82 | 21.18 | 20.57 | 20.00 | 19.46 | 18.95 | 18.46 | 18.00 | 17.56 | 17.14 | 16.74 | 16.36 | 16.00 | 15.65 | 15.32 | 15.00 |
| 1000.00 | 200.00 | 200.00 | 32.00 | 30.77 | 29.63 | 28.57 | 27.59 | 26.67 | 25.81 | 25.00 | 24.24 | 23.53 | 22.86 | 22.22 | 21.62 | 21.05 | 20.51 | 20.00 | 19.51 | 19.05 | 18.60 | 18.18 | 17.78 | 17.39 | 17.02 | 16.67 |
| 1100.00 | 220.00 | 220.00 | 35.20 | 33.85 | 32.59 | 31.43 | 30.34 | 29.33 | 28.39 | 27.50 | 26.67 | 25.88 | 25.14 | 24.44 | 23.78 | 23.16 | 22.56 | 22.00 | 21.46 | 20.95 | 20.47 | 20.00 | 19.56 | 19.13 | 18.72 | 18.33 |
| 1200.00 | 240.00 | 240.00 | 38.40 | 36.92 | 35.56 | 34.29 | 33.10 | 32.00 | 30.97 | 30.00 | 29.09 | 28.24 | 27.43 | 26.67 | 25.95 | 25.26 | 24.62 | 24.00 | 23.41 | 22.86 | 22.33 | 21.82 | 21.33 | 20.87 | 20.43 | 20.00 |
| 1300.00 | 260.00 | 260.00 | 41.60 | 40.00 | 38.52 | 37.14 | 35.86 | 34.67 | 33.55 | 32.50 | 31.52 | 30.59 | 29.71 | 28.89 | 28.11 | 27.37 | 26.67 | 26.00 | 25.37 | 24.76 | 24.19 | 23.64 | 23.11 | 22.61 | 22.13 | 21.67 |
| 1400.00 | 280.00 | 280.00 | 44.80 | 43.08 | 41.48 | 40.00 | 38.62 | 37.33 | 36.13 | 35.00 | 33.94 | 32.94 | 32.00 | 31.11 | 30.27 | 29.47 | 28.72 | 28.00 | 27.32 | 26.67 | 26.05 | 25.45 | 24.89 | 24.35 | 23.83 | 23.33 |
| 1500.00 | 300.00 | 300.00 | 48.00 | 46.15 | 44.44 | 42.86 | 41.38 | 40.00 | 38.71 | 37.50 | 36.36 | 35.29 | 34.29 | 33.33 | 32.43 | 31.58 | 30.77 | 30.00 | 29.29 | 28.57 | 27.91 | 27.27 | 26.67 | 25.09 | 25.53 | 25.00 |

-continued

Fourdrinier Frequency as a Function of Wire Speed and Foil Pitch Distance

| | | | | | | | | | | | | | | | | | | | | | | | | | | | |
|---|---|---|---|---|---|---|---|---|---|---|---|---|---|---|---|---|---|---|---|---|---|---|---|---|---|---|---|
| 1600.00 | 320.00 | 320.00 | 51.20 | 49.23 | 47.41 | 45.71 | 44.14 | 42.67 | 41.29 | 40.00 | 38.79 | 37.65 | 36.57 | 35.56 | 34.59 | 33.68 | 32.82 | 32.00 | 31.22 | 30.48 | 29.77 | 29.09 | 28.44 | 27.83 | 27.23 | 26.67 |
| 1700.00 | 340.00 | 340.00 | 54.40 | 52.31 | 50.37 | 48.57 | 46.90 | 45.33 | 43.87 | 42.50 | 41.21 | 40.00 | 38.86 | 37.78 | 36.76 | 35.79 | 34.87 | 34.00 | 33.17 | 32.38 | 31.63 | 30.91 | 30.22 | 29.57 | 28.94 | 28.33 |
| 1800.00 | 360.00 | 360.00 | 57.60 | 55.38 | 53.33 | 51.43 | 49.66 | 48.00 | 46.45 | 45.00 | 43.64 | 42.35 | 41.14 | 40.00 | 38.92 | 37.89 | 36.92 | 36.00 | 35.12 | 34.29 | 33.49 | 32.73 | 32.00 | 31.30 | 30.64 | 30.00 |
| 1900.00 | 380.00 | 380.00 | 60.80 | 58.46 | 56.30 | 54.29 | 52.41 | 50.67 | 49.03 | 47.50 | 46.06 | 44.71 | 43.43 | 42.22 | 41.08 | 40.00 | 38.97 | 38.00 | 37.07 | 36.19 | 35.35 | 34.55 | 33.78 | 33.04 | 32.34 | 31.67 |
| 2000.00 | 400.00 | 400.00 | 64.00 | 61.54 | 59.26 | 57.14 | 55.17 | 53.33 | 51.61 | 50.00 | 48.48 | 47.06 | 45.71 | 44.44 | 43.24 | 42.11 | 41.03 | 40.00 | 39.02 | 38.10 | 37.21 | 36.36 | 35.56 | 34.78 | 34.04 | 33.33 |
| 2100.00 | 420.00 | 420.00 | 67.20 | 64.62 | 62.22 | 60.00 | 57.93 | 56.00 | 54.19 | 52.50 | 50.91 | 49.41 | 48.00 | 46.67 | 45.41 | 44.21 | 43.08 | 42.00 | 40.98 | 40.00 | 39.07 | 38.18 | 37.33 | 36.52 | 35.74 | 35.00 |
| 2200.00 | 440.00 | 440.00 | 70.40 | 67.69 | 65.19 | 62.86 | 60.00 | 58.67 | 56.77 | 55.00 | 53.33 | 51.76 | 50.29 | 48.89 | 47.57 | 46.32 | 45.13 | 44.00 | 42.93 | 41.90 | 40.93 | 40.00 | 39.11 | 38.26 | 37.45 | 36.67 |
| 2300.00 | 460.00 | 460.00 | 73.60 | 70.77 | 68.15 | 65.71 | 63.45 | 61.33 | 59.35 | 57.50 | 55.76 | 54.12 | 52.57 | 51.11 | 49.73 | 48.42 | 47.18 | 46.00 | 44.88 | 43.81 | 42.79 | 41.82 | 40.89 | 40.00 | 39.15 | 38.33 |
| 2400.00 | 480.00 | 480.00 | 76.80 | 73.85 | 71.11 | 68.57 | 66.21 | 64.00 | 61.94 | 60.00 | 58.18 | 56.47 | 54.86 | 53.33 | 51.89 | 50.53 | 49.23 | 48.00 | 45.83 | 45.71 | 44.65 | 43.64 | 42.67 | 41.74 | 40.85 | 40.00 |
| 2500.00 | 500.00 | 500.00 | 80.00 | 76.92 | 74.07 | 71.43 | 68.97 | 66.67 | 64.52 | 62.50 | 60.61 | 58.82 | 57.14 | 55.56 | 54.05 | 52.63 | 51.28 | 50.00 | 48.78 | 47.62 | 46.51 | 45.45 | 44.44 | 43.48 | 42.55 | 41.67 |
| 2600.00 | 520.00 | 520.00 | 83.20 | 80.00 | 77.04 | 74.29 | 71.72 | 69.33 | 67.10 | 65.00 | 63.03 | 61.18 | 59.43 | 57.78 | 56.22 | 54.74 | 53.33 | 52.00 | 50.73 | 49.52 | 48.37 | 47.27 | 46.22 | 45.22 | 44.26 | 43.33 |
| 2700.00 | 540.00 | 540.00 | 86.40 | 83.08 | 80.00 | 77.14 | 74.48 | 72.00 | 69.68 | 67.50 | 65.45 | 63.53 | 61.71 | 60.00 | 58.38 | 56.84 | 55.38 | 54.00 | 52.68 | 51.43 | 50.23 | 49.09 | 48.00 | 46.96 | 45.96 | 45.00 |
| 2800.00 | 560.00 | 560.00 | 89.60 | 86.15 | 82.96 | 80.00 | 77.24 | 74.67 | 72.26 | 70.00 | 67.88 | 65.88 | 64.00 | 62.22 | 60.54 | 58.95 | 57.44 | 56.00 | 54.63 | 53.33 | 52.09 | 50.91 | 49.78 | 48.70 | 47.66 | 46.67 |
| 2900.00 | 580.00 | 580.00 | 92.80 | 89.23 | 85.93 | 82.85 | 80.00 | 77.33 | 74.84 | 72.50 | 70.30 | 68.24 | 66.29 | 64.44 | 62.70 | 61.06 | 59.49 | 58.00 | 55.59 | 55.24 | 53.95 | 52.73 | 51.56 | 50.43 | 49.36 | 48.33 |
| 3000.00 | 600.00 | 600.00 | 96.00 | 92.31 | 88.89 | 85.71 | 82.76 | 80.00 | 77.42 | 75.00 | 72.73 | 70.59 | 68.57 | 66.67 | 64.86 | 63.16 | 61.54 | 60.00 | 58.54 | 57.14 | 55.81 | 54.55 | 53.33 | 52.17 | 51.06 | 50.00 |

| | | | | | | | | | | | | | | | | | | | | | | | | | | | |
|---|---|---|---|---|---|---|---|---|---|---|---|---|---|---|---|---|---|---|---|---|---|---|---|---|---|---|---|
| 3100.00 | 620.00 | 620.00 | 99.20 | 96.38 | 91.85 | 88.67 | 85.67 | 82.67 | 80.00 | 77.50 | 75.15 | 72.94 | 70.86 | 68.89 | 67.03 | 65.24 | 63.65 | 62.00 | 60.49 | 59.06 | 57.67 | 56.35 | 55.11 | 53.91 | 52.77 | 51.67 |
| 3200.00 | 640.00 | 640.00 | 102.40 | 98.46 | 94.81 | 91.43 | 88.28 | 85.33 | 82.58 | 80.00 | 77.58 | 75.29 | 73.14 | 71.11 | 69.19 | 67.37 | 65.64 | 64.00 | 62.44 | 60.95 | 59.53 | 58.18 | 56.89 | 55.65 | 54.47 | 53.33 |
| 3300.00 | 660.00 | 660.00 | 105.60 | 101.54 | 97.87 | 94.29 | 91.03 | 88.00 | 85.16 | 82.50 | 80.00 | 77.65 | 75.43 | 73.33 | 71.35 | 69.47 | 67.69 | 66.00 | 64.38 | 62.85 | 61.40 | 60.00 | 58.67 | 57.39 | 55.17 | 55.00 |
| 3400.00 | 680.00 | 680.00 | 108.80 | 104.62 | 100.74 | 97.14 | 93.79 | 90.67 | 87.74 | 85.00 | 82.42 | 80.00 | 77.71 | 75.56 | 73.51 | 71.58 | 69.74 | 68.00 | 66.34 | 64.76 | 63.26 | 61.82 | 60.44 | 59.13 | 57.87 | 56.57 |
| 3500.00 | 700.00 | 700.00 | 112.00 | 107.69 | 103.70 | 100.00 | 96.55 | 93.33 | 90.32 | 87.50 | 84.85 | 82.35 | 80.00 | 77.78 | 75.68 | 73.68 | 71.79 | 70.00 | 68.29 | 66.67 | 65.12 | 63.64 | 62.22 | 60.87 | 59.57 | 58.33 |
| 3600.00 | 720.00 | 720.00 | 115.20 | 110.77 | 106.67 | 102.86 | 99.31 | 96.00 | 92.90 | 90.00 | 87.27 | 84.71 | 82.29 | 80.00 | 77.84 | 75.79 | 73.85 | 72.00 | 70.24 | 68.57 | 66.98 | 65.45 | 64.00 | 62.61 | 61.28 | 60.00 |
| 3700.00 | 740.00 | 740.00 | 118.40 | 113.85 | 109.63 | 105.71 | 102.07 | 98.67 | 95.48 | 92.50 | 89.70 | 87.06 | 84.57 | 82.22 | 80.00 | 77.89 | 75.90 | 74.00 | 72.20 | 70.48 | 68.84 | 67.27 | 65.76 | 64.35 | 62.98 | 61.67 |
| 3800.00 | 760.00 | 760.00 | 121.60 | 116.92 | 112.59 | 108.57 | 104.83 | 101.33 | 98.06 | 95.00 | 92.12 | 89.41 | 86.86 | 84.44 | 82.16 | 80.00 | 77.95 | 76.00 | 74.15 | 72.38 | 70.70 | 69.09 | 67.56 | 66.09 | 64.68 | 63.33 |
| 3900.00 | 780.00 | 780.00 | 124.80 | 120.00 | 115.56 | 111.43 | 107.59 | 104.00 | 100.65 | 97.50 | 94.55 | 91.76 | 89.14 | 86.67 | 84.32 | 82.11 | 80.00 | 78.00 | 76.10 | 74.29 | 72.56 | 70.91 | 69.33 | 67.83 | 66.38 | 65.00 |
| 4000.00 | 800.00 | 800.00 | 128.00 | 123.08 | 118.52 | 114.29 | 110.34 | 106.67 | 103.23 | 100.00 | 96.97 | 94.12 | 91.43 | 88.89 | 86.49 | 84.21 | 82.05 | 80.00 | 78.05 | 76.19 | 74.42 | 72.73 | 71.11 | 69.57 | 68.09 | 66.67 |
| 4100.00 | 820.00 | 820.00 | 131.20 | 126.15 | 121.48 | 117.14 | 113.10 | 109.33 | 105.81 | 102.50 | 99.39 | 96.47 | 93.71 | 91.11 | 88.65 | 86.32 | 84.10 | 82.00 | 80.00 | 78.10 | 76.28 | 74.56 | 72.89 | 71.30 | 69.79 | 68.33 |
| 4200.00 | 840.00 | 840.00 | 134.40 | 129.23 | 124.44 | 120.00 | 115.86 | 112.00 | 108.39 | 105.00 | 101.82 | 98.82 | 96.00 | 93.33 | 90.81 | 88.42 | 86.15 | 84.00 | 81.95 | 80.00 | 78.14 | 76.36 | 74.67 | 73.04 | 71.49 | 70.00 |
| 4300.00 | 860.00 | 860.00 | 137.60 | 132.31 | 127.41 | 122.86 | 118.62 | 114.67 | 110.97 | 107.50 | 104.24 | 101.18 | 98.29 | 95.56 | 92.97 | 90.53 | 88.21 | 86.00 | 83.90 | 81.90 | 80.00 | 78.18 | 76.44 | 74.78 | 73.19 | 71.67 |
| 4400.00 | 880.00 | 880.00 | 140.80 | 135.38 | 130.37 | 125.71 | 121.38 | 117.33 | 113.55 | 110.00 | 106.67 | 103.53 | 100.57 | 97.78 | 95.14 | 92.63 | 90.26 | 88.00 | 85.85 | 83.81 | 81.90 | 80.00 | 78.22 | 76.52 | 74.89 | 73.33 |
| 4500.00 | 900.00 | 900.00 | 144.00 | 138.46 | 133.33 | 128.57 | 124.14 | 120.00 | 116.13 | 112.50 | 109.09 | 105.88 | 102.86 | 100.00 | 97.30 | 94.74 | 92.31 | 90.00 | 87.80 | 85.71 | 83.72 | 81.82 | 80.00 | 78.26 | 76.60 | 75.00 |

Figure 5:
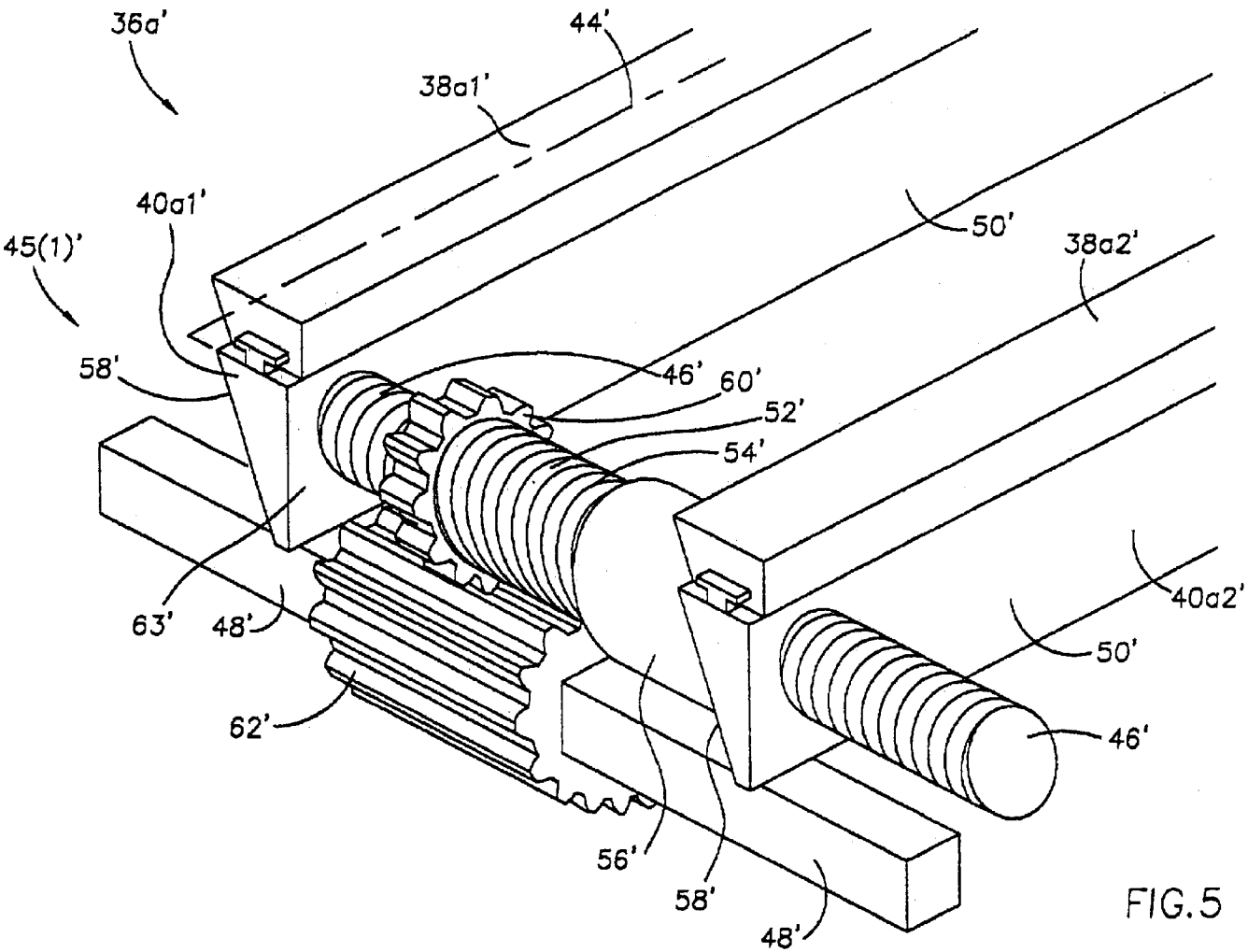
FIG. 5 is a perspective, partial view of embodiment of a variable frequency foil box according to the invention utilizing a double acting screw mechanism to move the foil support beams.

One embodiment of an actuating mechanism 45(1)' utilized in a variable frequency foil box (set) according to the invention to alter the frequency of a Fourdrinier table is depicted in FIG. 5, illustrated as VFF box (set) 36*a*' for explanation purposes. The actuating mechanism 45(1)' of the VFF set 36*a*' comprises a series combination of double-lead acme type screws 46' engaged with a single rotatable carrier or device shaft 48' via spur gears 60', 62', which utilizes a common actuating means (not shown), such as an electric motor, an air motor and valving system, or other mechanism known and used in the art. The actuating mechanism 45(1)' is operable to provide equidistant spacing of the foil support beams 40', and adjacent foil sets (36') (not shown) on the Fourdrinier table. The shaft 48' is oriented perpendicular to the foil support beams. A male threaded lead screw 46' is affixed to the trailing side 50' of each foil support beam 40*a*1', 40*a*2'. A "double threaded" rotating nut 52' with a mating female thread on the inner surface (not shown) is engaged onto the male threaded lead screw 46'. The outside diameter of the nut 52' is machined with an opposite hand thread (outer thread) 54' of identical pitch as the male threaded lead screw 46'. The outer thread 54' of the rotatable nut 52' is engaged with the inner threads (not shown) of a mating (fixed) nut 56' affixed to the leading side 58' of the following (trailing) foil support beam 40*a*2'. A gear 60' affixed to the face of the rotatable nut 52' meshes with a second gear 62" affixed to a rotatable carrier shaft 48'.

Rotating the carrier shaft 48' turns the double threaded rotatable nut 52'. As the double threaded nut 52' turns in one direction, it further engages the lead screw 46' on the leading foil support beam 40*a*1' while being further engaged into the mating (fixed) nut 56' mounted on the trailing foil support beam 40*a*2'. As the carrier shaft 48' rotates in the opposite direction, the process reverses. The carrier shaft 48' has additional gears affixed to it (not shown) that simultaneously actuate an identical mechanism for the subsequent foil support beams 40*a*3', 40*a*4', 40*a*5' (not shown). With the first (leading) foil beam 40*a*1', 40*b*1', 40*c*1' of each foil set 41*a*'–41*c*' affixed to the box, and each subsequent foil beam connected to the preceding foil beam via the aforementioned mechanism, equidistant spacing of the intermediate and trailing foil beams is maintained throughout the range of adjustment. The actuating mechanism 45(1)' is preferably located at or near the ends 63' of the foil support beams 40'. Additional mechanisms 45(1) can be equally spaced between the ends on boxes of greater width.

Figure 6:
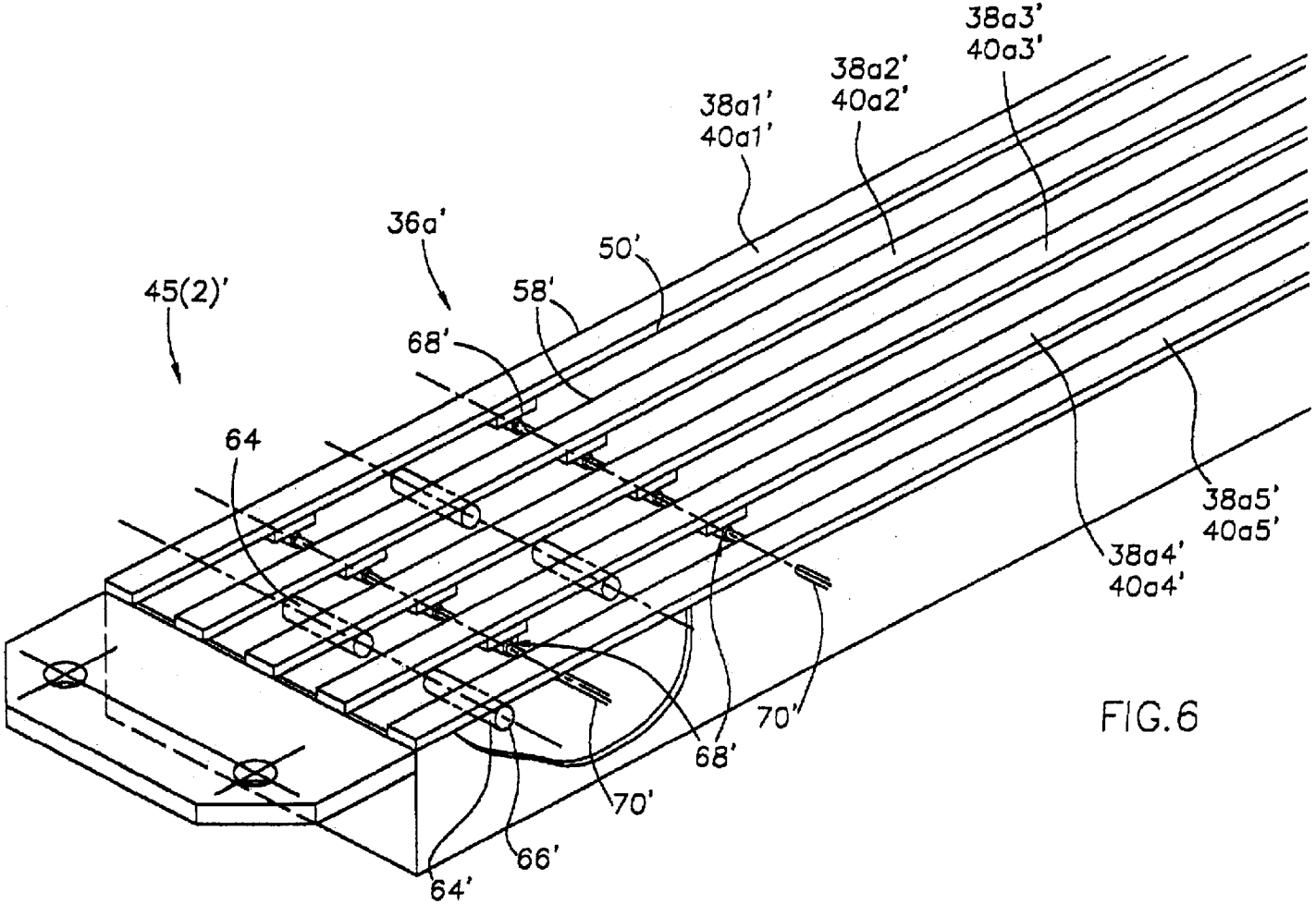
FIG. 6 is a perspective view of another embodiment of a variable frequency foil box according to the invention utilizing a foil box arrangement using a hydraulic/pneumatic cylinder mechanism to move the foil support beams.

Another embodiment of a variable frequency foil (VFF) box of the invention is depicted in FIG. 6, illustrated as VFF box 36*a*'. As shown, VFF box 36*a*' comprises five foils 38*a*1'–38*a*5', each mounted on a foil support beam 40*a*1'–40*a*5'. As further depicted, the variable frequency foil box 36*a*' utilizes an actuating mechanism 45(2)' comprising a series combination of hydraulic or pneumatic cylinders 64' with integral position feedback transducers 66', utilizing an electronically-controlled system of actuating valves (not shown). The actuating mechanism 45(2)' is utilized to accomplish the equidistant spacing of foils 38*a*1'–38*a*5' and adjacent foil sets (not shown) by lateral movement. In the illustrated embodiment, at least two hydraulic or pneumatic cylinders 64' are attached to each foil support beam 40*a*1'–40*a*5' with the ends of the cylinders (rod-ends), affixed to the upstream (leading) side 58' of the foil beam or the downstream (trailing) side 50' of the foil beam (as shown). The individual foil beams 40*a*1'–40*a*5' are preferably supported by at least two linear bearings 68' (i.e., linear pillow blocks) that are supported by shafts 70' oriented perpendicular to the foil support beams 40*a*1'–40*a*5' to insure the lateral alignment of the beams in the machine such that the support beams are held down and do not move in either lateral or vertical directions.

An electronic control system utilizing a programmable logic controller (PLC) (not shown) can be used to actuate the cylinder valves 64' to effect changes in the relative position of adjacent foil support beams 40*a*1–40*a*5'. The cylinders 64' preferably comprise position transducers 66' that provide a feedback signal to the PLC to indicate position changes. Further "tuning" of the foil positions can be effected by the PLC to position the foil beams 40*a*1'–40*a*5' and foils 38*a*1'–38*a*5' in the precise location(s) required to achieve the desired box frequency.

Figure 7:
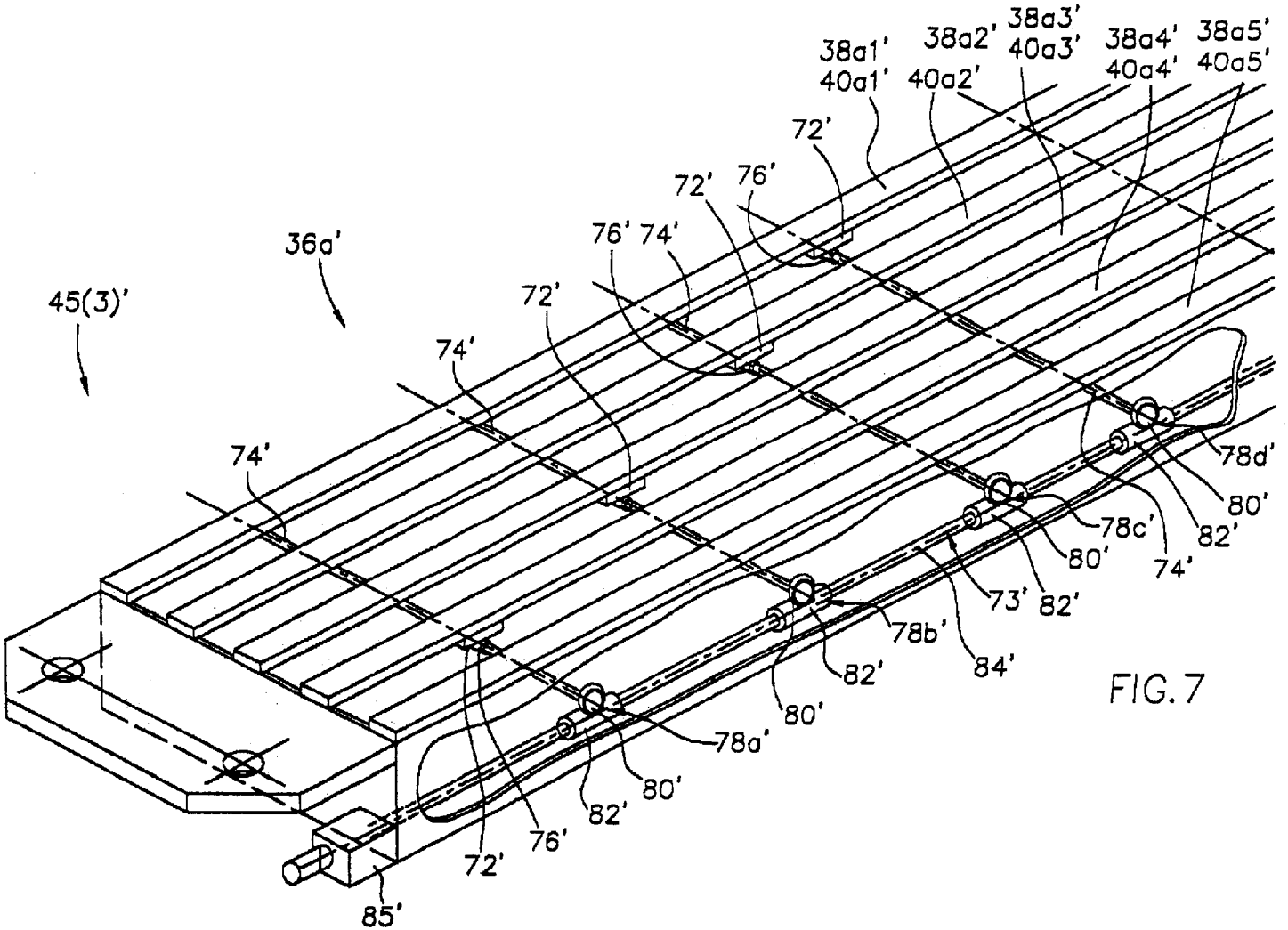
FIG. 7 is a perspective view of another embodiment of a variable frequency foil box according to the invention utilizing a multiple lead screw mechanism to move the foil support beams.

Another embodiment of a variable frequency foil box according to the invention is depicted in FIG. 7, illustrated as VFF box 36*a*' for discussion purposes. As shown, the variable frequency foil box 36*a*' utilizes an actuating mechanism 45(3)' comprising a series of actuating (lead) screw (ball screw) assemblies 72', along with a common actuator 73', which are utilized to accomplish the equidistant spacing of foils 38*a*1'–38*a*5' and adjacent foil sets (not shown). In this embodiment, each foil support beam 40*a*1'–40*a*5' incorporates a nut 76' into which an actuating (lead) screw 74' is engaged, the axis of the actuating screw being perpendicular to that of the foil support beams 40*a*1'–40*a*5'. Preferably, each foil beam 40*a*1'–40*a*5' comprises at least two nut/actuating screw assemblies positioned along the length of the foil beam. The actuating screw 74' extends forward (or backward) to a point beyond the leading foil beam 40*a*1' (or trailing foil beam 40*a*2'–40*a*5'). The actuating means (actuator) 73' for each actuating screw assembly 72' comprises a worm gear assembly (or worm and pinion assembly) 78*a*'–78*d*' whereby the gear 80' is affixed to the actuating screw 74' and the engaging worms 82' are coupled in parallel by a common drive shaft 84' that is connected to an actuating device 85' such as a drive motor, a hydraulic or pneumatic pump, an air compressor and valve system, or other like mechanism known and used in the art for turning a drive shaft. The worm gear ratios increase incrementally from one actuating screw to the next actuating screw, for example, a ratio of about 10:1 for worm gear assembly 78*a*', an about 10:2 ratio for assembly 78*b*', an about 10:3 ratio for assembly 78*c*', an about 10:4 ratio for assembly 78*d*', and so forth, whereby ten (10) revolutions of the worm 82' yields one (1) (or 2, 3, 4, etc.) revolution of the gear 80' to insure the equidistant spacing of each foil beam 40*a*1'–40*a*5' throughout their respective ranges of motion. Referring to the embodiment shown in FIG. 6, the individual foil beams 40*a*1'–40*a*5' are preferably supported by at least two linear bearings (i.e., linear pillow blocks) 68' that are supported by shafts 70' oriented perpendicular to the foil beams 40*a*1'–40*a*5' to insure the lateral alignment of the beams in the machine such that the beams are held down and do not move in either lateral or vertical directions. The linear bearings (68') can be designed and sized such that the actuating lead screws 74' pass through the linear bearings (68') without engaging screw threads, in order to provide additional support to the actuating screws 74'. With this embodiment, the number of parts (i.e., part count) that comprise the assembly 45(3)' and subsequent alignment requirements are greatly simplified.

Figure 8A:
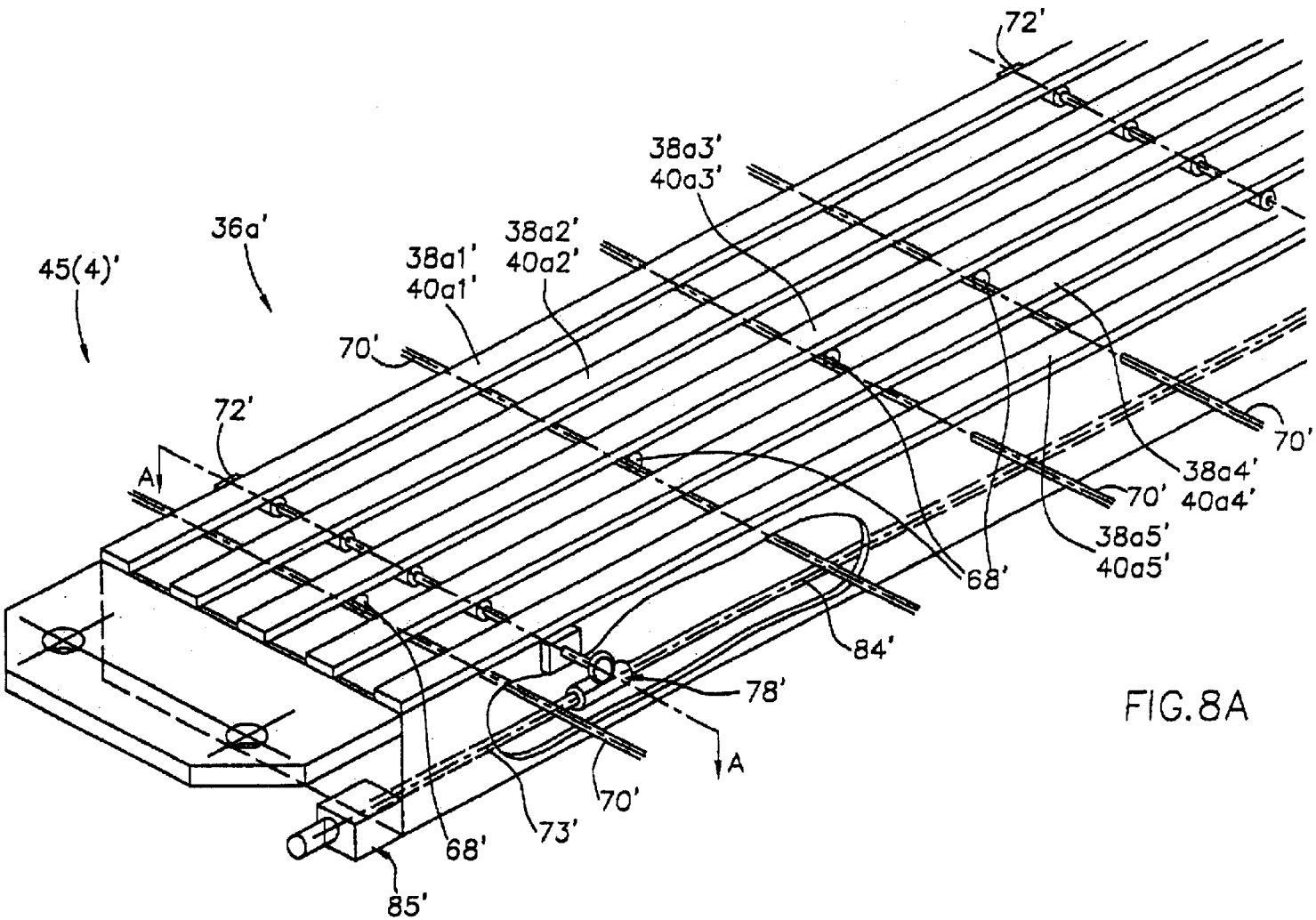
FIGS. 8A–8C are illustrations of another embodiment of a variable frequency foil box according to the invention utilizing pantograph assemblies to move the foil support beams.
Figure 8B:
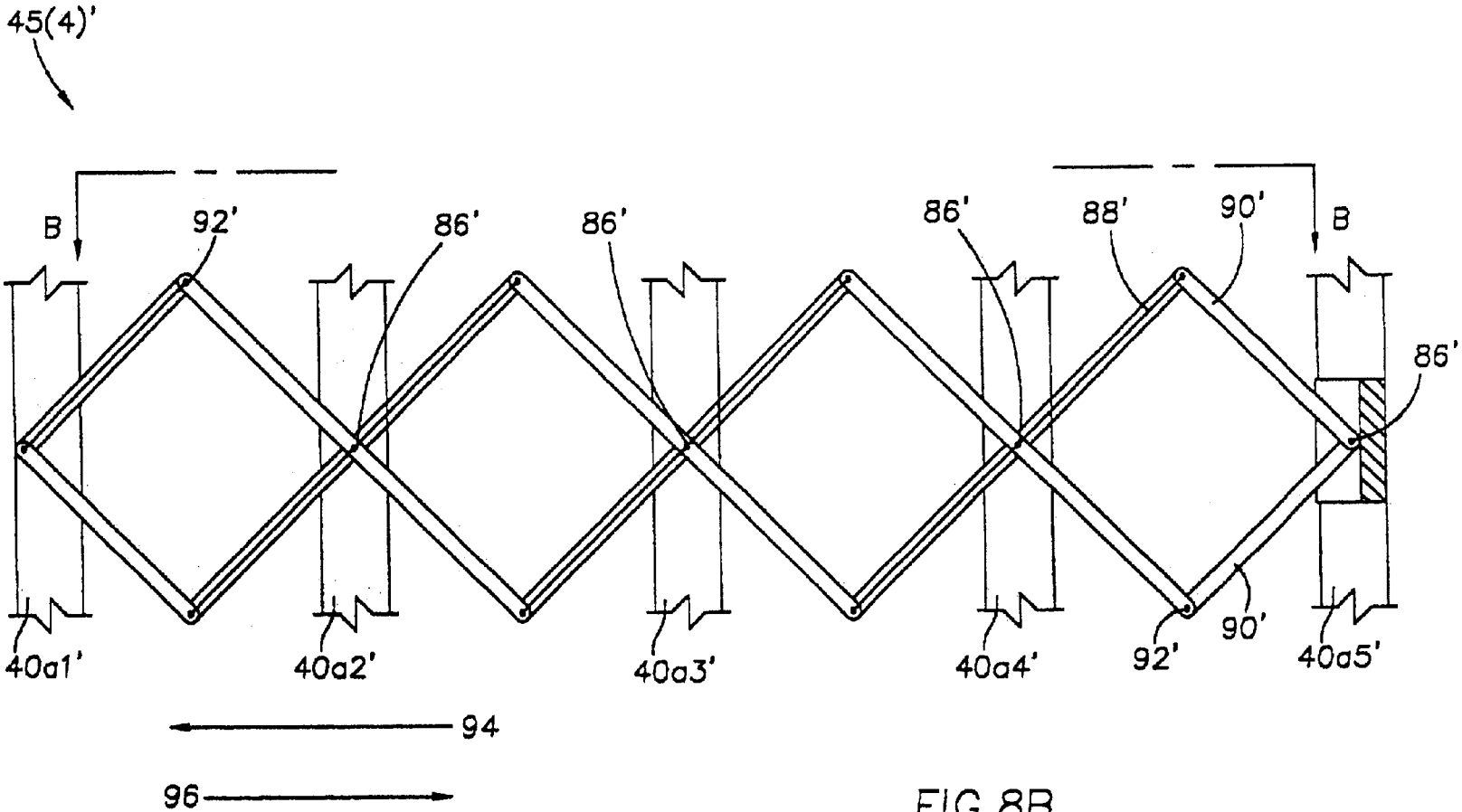
Figure 8C:
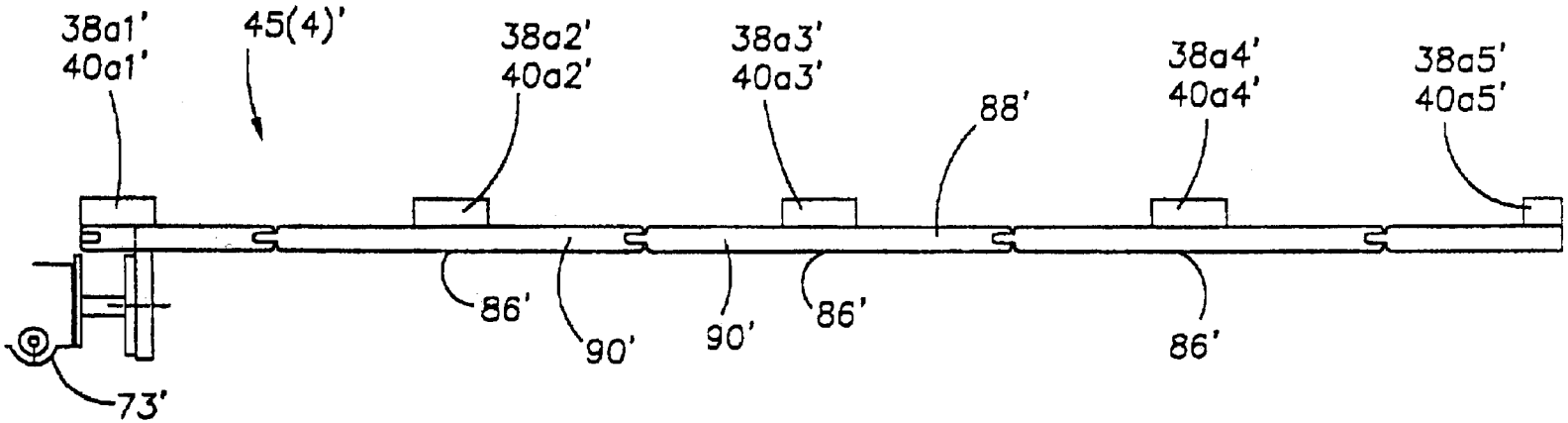

As shown in FIGS. 8A–8C, in another embodiment of a variable frequency foil box, illustrated as VFF set 36*a*', at least two pantograph assemblies 88' are utilized as a mechanism 45(4)' along with a common actuating means (actuator) (not shown) to accomplish the equidistant spacing of the foil beams 40*a*1'–40*a*5', and adjacent foil sets (not shown).

Referring to FIG. 8B, each foil beam 40*a*1'–40*a*5' is attached to a center pivot 86' of the pantograph assembly 88' which, by design, insures that the spacing between the foil support beams 40*a*1'–40*a*5' remains substantially equidistant throughout the range of motion. The pantograph assembly 88' comprises links 90' that are secured with a fastener 92' at the pivot point of the links, including the center pivots 86' of the pantograph assembly. In operation, the pantograph assembly 88' accordions or extends (expands) outward (arrow 94') and retracts inward (arrow 96'), which draws at least the intermediate foil beams 40*a*2'–40*a*4' along and into position. The position of the trailing blade 38*a*5' can be adjusted by use of at least two linear actuating (lead) screw assemblies 72' connected in parallel by a common drive shaft 84', and attached to both the leading foil beam 40*a*1' and the trailing foil beam 40*a*5'. As the actuating screw assembly 72' moves the trailing foil beam 40*a*5', the pantograph assembly 88' draws the intermediate foil beams 40*a*2'–40*a*4', which are moved proportionally with the trailing foil beam 40*a*5'. The individual foil beams 40*a*1'–40*a*5' are preferably supported by at least two linear bearings 68' (i.e., linear pillow blocks) supported by shafts 70' oriented perpendicular to the foil support beams 40*a*1'–40*a*5' to insure the lateral alignment of the beams in the machine and to control lateral and vertical movement.

Figure 9A:
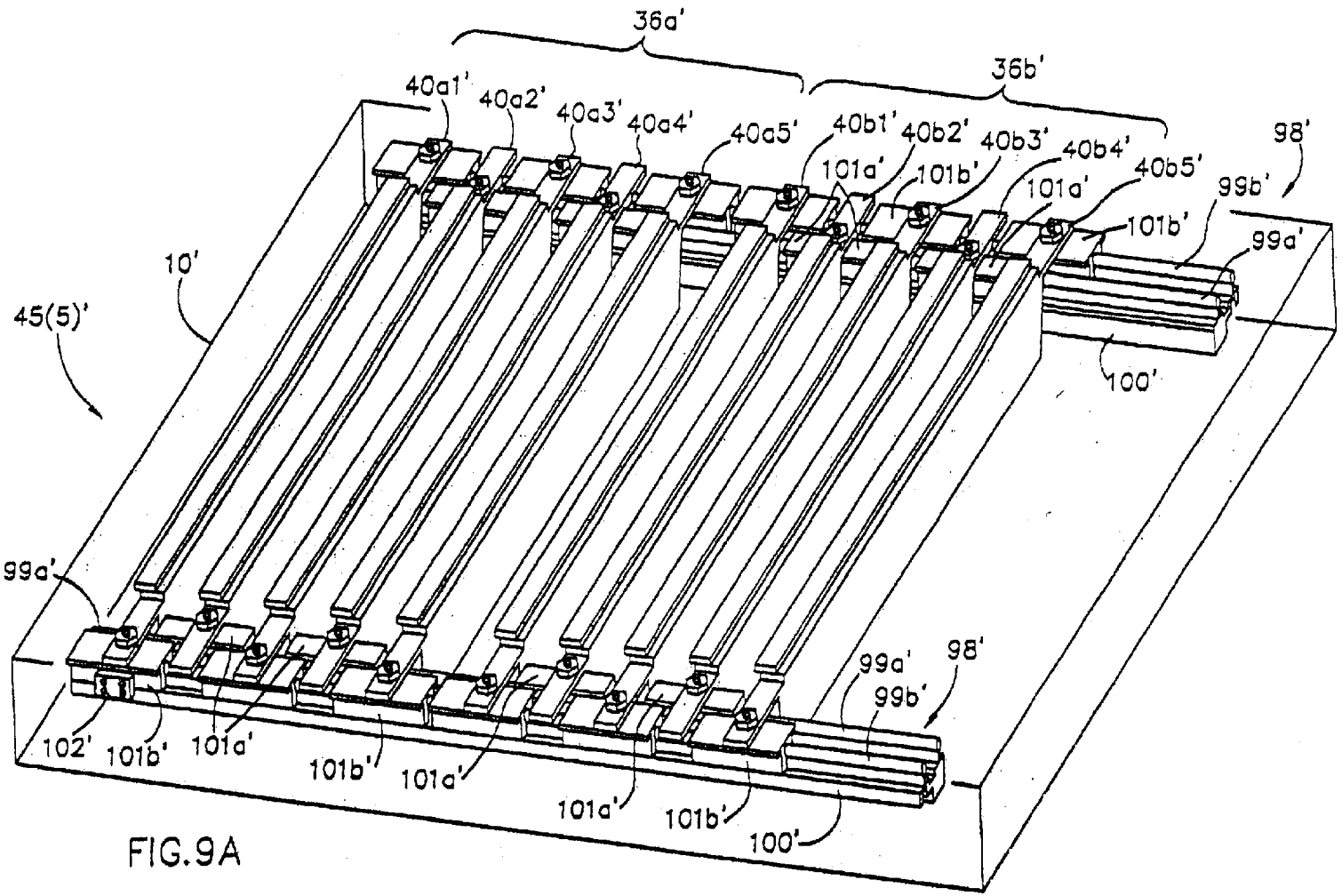

Another embodiment of a variable frequency foil box according to the invention, illustrated as VFF sets 36*a*', 36*b*', is depicted in FIGS. 9A–9B. As shown, a linear rail system 98' for supporting the foil beams can be used in place of a conventional "box" type structure (e.g., FIG. 6). The linear rail system 98' can be affixed to the frame 100' of a Fourdrinier table 10' (shown in phantom). Preferably, as shown, the rail system 98' comprises two parallel rails, pairs of rails, an inner rail pair 99*a*' and an outer rail pair 99*b*'. The foil beams can be mounted on the rail pairs 99*a*', 99*b*' by means of linear bearings 101*a*', 101*b*'. The foil beams are preferably mounted on the rails 99*a*', 99*b*' in an offset or alternating manner, such that one bearing 101*a*' (and beam) is mounted on the inner rail pair 99*a*' and the adjacent or following bearing 101*b*' (and beam) is mounted on the outer rail pair 99*b*'. By offsetting or alternating the placement of the linear bearings 101*a*', 101*b*' of adjacent foil beams on the inner and outer rail pairs 99*a*', 99*b*', the beams can be moved relatively close together. Additionally, in this configuration, the distance that the leading support beam 40*b*1' of the second (trailing) foil beam set 36*b*' can travel forward is increased, thus yielding application over a broader range of machine speeds and table frequencies than with a conventional box-type structure where the end of the box limits how far the leading foil beam 40*b*1' can travel forward.

As shown in FIG. 9B, the two foil beam sets 36*a*', 36*b*', totaling ten (10) beams are illustrated as being interconnected utilizing an actuating mechanism 45(5)' comprising a telescoping assembly (122') and pantograph assemblies 88', although another of the actuating mechanisms and methods described herein can be utilized to accomplish equidistant spacing of the foils beams 40*a*1'–40*a*5', 40*b*1'–40*b*5', and the foil beam sets 36*a*', 36*b*'.

As illustrated, each of the foil beam sets 36*a*', 36*b*', comprise a leading foil beam 40*a*1', 40*b*1', three trailing intermediate foil beams 40*a*2'–40*a*4', 40*b*2'–40*b*4', and a trailing end foil beam 40*a*5', 40*b*5'. In the first foil beam set 36*a*', the leading foil support beam 40*a*1' is affixed on the rail by a mounting (bracket) device 102'. An actuating mechanism 45(1)'–45(5)' according to the invention, and also subsequently described mechanism 45(6)', can be used to move and space apart the intermediate foil support beams 40*a*2'–40*a*4', and the trailing support beam 40*a*5' of the first beam set 36*a*' at a distance X relative to the leading support beam 40*a*1'. In the second foil beam set 36*b*', the leading support beam 40*b*1' is not affixed to the rail and is slideable along the rail. The actuating mechanism of the invention that is utilized, functions to move the (second) leading support beam 40*b*1' at an integer multiple of X distance (1X, 2X, 3X, etc.) relative to the preceding trailing support beam 40*a*5' of the first foil beam set 36*a*'. The intermediate foil support beam 40*b*2'–40*b*4', and the trailing support beams 40*b*5' of the second foil beam set 41*b*' are moved and spaced apart at a distance X relative to the (second) leading support beam 40*b*1'.

Referring again to FIG. 9B, at least two right-angle gearboxes 104' (illustrated as four gear boxes) are attached to the leading foil support beam 40*a*1', 40*b*1' of each foil set 36*a*', 36*b*'. The gearboxes 104' are connected to each other via connecting shafts 106' to provide uniform rotary motion of the output shafts 108'. Connected to each gearbox 104' is a lead screw 110', preferably having 6 threads per inch (6-pitch screw). Each lead screw 110' is engaged into a mating nut 112', which is in turn attached to the trailing support beam 40*a*5', 40*b*5' via a mounting (bracket) assembly 114' that anchors the mating nut 112' and prevents rotation. An additional right-angle (outboard) gearbox 116*a*', 116*b*' is mounted near the end of each of the leading support beams 40*a*1 ', 40*b*1 '. The outboard gearbox 116*a*', 116*b*' is connected to the adjacent gearbox 104' via a connecting (output) shaft 120*a*'.

The output shaft 124' of the outboard gearbox 116*a*' is connected to a telescoping spline shaft assembly 122', which is in turn attached to the input shaft (not shown) of the outboard gearbox 116*b*' attached to the (second) leading support beam 40*b* 1'. This assembly connects the two foil sets 36*a*, 36*b*' together. The outboard gearbox 116*b*' on the (second) leading support beam 40*b*1' is connected via connecting output shaft 120*b*' to the adjacent gearbox 104', by shafts 106' to the remaining gearboxes 104', and by output shaft 120*b*" to another outboard gearbox 116*b*" mounted at the opposite end of the leading support beam 40*b*1', to control the foils of the second foil set 36*b*'.

The secondary output shafts (not shown) of the outboard gear boxes 116*b*', 116*b*", are coupled to screws 130', preferably having 4 threads per inch (4-pitch screws). The screws 130' are engaged into mating nuts 132' that are mounted to the rigid machine frame 100' via mounting brackets 134'.

To adjust the foil box assembly, the input shaft 136' on the outboard gearbox 116*a*' of the (first) leading support beam 40*a*1' is rotated. This, in turn, rotates all of the gearbox output shafts (and connected screws and shafts) at a 1:1 ratio.

As the assembly in FIGS. 9A–9B is illustrated as having five (5) foils per foil set 36*a*', 36*b*', there exists four (4) interfoil spaces at a distance (X). The interset space between the first foil set 36*a*' and the second foil set 36*b*' is twice (2X) the standard distance (X) between adjacent foils within each of the sets. During adjustment of the frequency of the table, it is preferred that the (first) leading foil support beam 40*a*1' of the first foil set 41*a*' is moved 1.5 times (1.5X) the distance that the trailing support beam 40*a*5' of the first foil set 41*a*' is moved. To insure this relationship, it is preferred that a 6-pitch screw is used within the foil sets 41*a*', 41*b*', and a 4-pitch screw is used between the foil sets 41*a*', 41*b*'.

Figure 10:
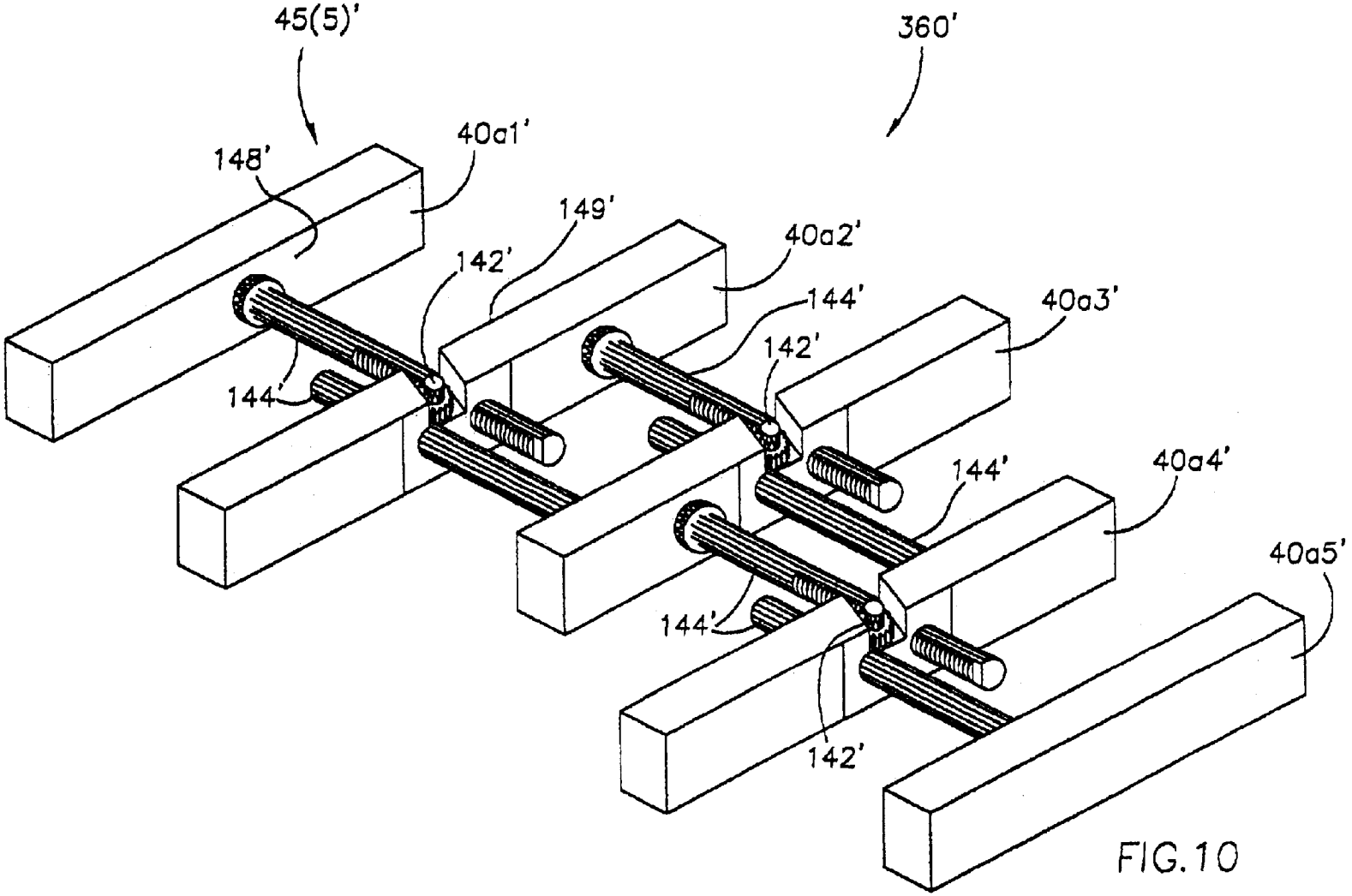
FIG. 10 is another embodiment of a variable frequency foil box of the invention illustrating a rack and pinion gearing mechanism that can be utilized to establish and maintain equidistant spacing between adjacent foil beams.

As shown in FIG. 10, in yet another embodiment of a variable frequency foil box according to the invention, illustrated as foil set 36*a*', opposing rack and pinion gear sets are utilized as an actuating mechanism 45(6)' to accomplish equidistant spacing of foil support beams 40*a*1'–40*a*5', and the foil sets (not shown). The actuating mechanism 45(5)' comprises at least two pinion gears 142' pivotally mounted within the intermediate foil support beams 40*a*2'–40*a*4'. The ends of the rack gears 144' that engage the pinion gears 142' are rigidly attached to the opposing surfaces of the adjacent support beams, for example, as shown with regard to the attachment of the rack gear 144' to surface 148' of the foil beam 40*a*1 ' and the opposing surface 149' of the foil beam 40*a*2'. This design insures that the spacing between the foil support beams 40*a*1'–40*a*5' remains substantially equidistant throughout the range of motion. The actuating mechanism 45(6)' can be utilized in place of the pantograph mechanism 88' described and illustrated with reference to FIG. 9B.

In the use of the actuating mechanism 45(5)', the positions of the intermediate foil beams 40*a*2'–40*a*4' and the trailing foil beam 40*a*5' can be adjusted by the use of at least two linear actuating (lead) screw assemblies (72') (not shown) similar to that depicted and described with reference to FIGS. 7 and 8A, that are connected in parallel to the foil beams and by a common actuator (73') comprising a drive shaft (not shown). As the actuating screw assemblies (72') move the trailing foil beam 40*a*5', the rack and pinion gear assembly mechanism 45(5)' draws the intermediate foil beams 40*a*2'–40*a*4', which are moved proportionally with the trailing foil beam 40*a*5'. The individual foil beams 40*a*1'–40*a*5' are preferably supported by at least two linear bearings (e.g., linear pillow blocks), for example, as shown and described with reference to FIGS. 6 and 8A (68'), that are supported by shafts (70') oriented perpendicular to the foil support beams 40*a*1'–40*a*5' to insure the lateral alignment of the beams in the machine and to control lateral and vertical movement.

The aforementioned mechanisms and methods can be utilized in any combination to construct variable frequency "boxes", foil sets and/or entire variable frequency gravity tables. The variable frequency box of the invention has numerous applications where paper machines are scheduled to run a variety of papers at varying speeds and stock consistencies. Examples include, but are not limited to, fine paper manufacturers, publication papers, liner board, security papers, and the like.

The mechanisms 45(1)'–45(5)' of the invention described herein can be readily combined with other known assemblies to alter the angle of each individual foil blade and/or raise or lower each foil blade into and out of contact with the Fourdrinier wire.

The described foil beam assemblies operate in an environment prone to contamination of the working parts. It is understood that the parts and mechanism described herein can be sealed or shielded during operation according to conventional methods to inhibit such contamination.

Figure 11:
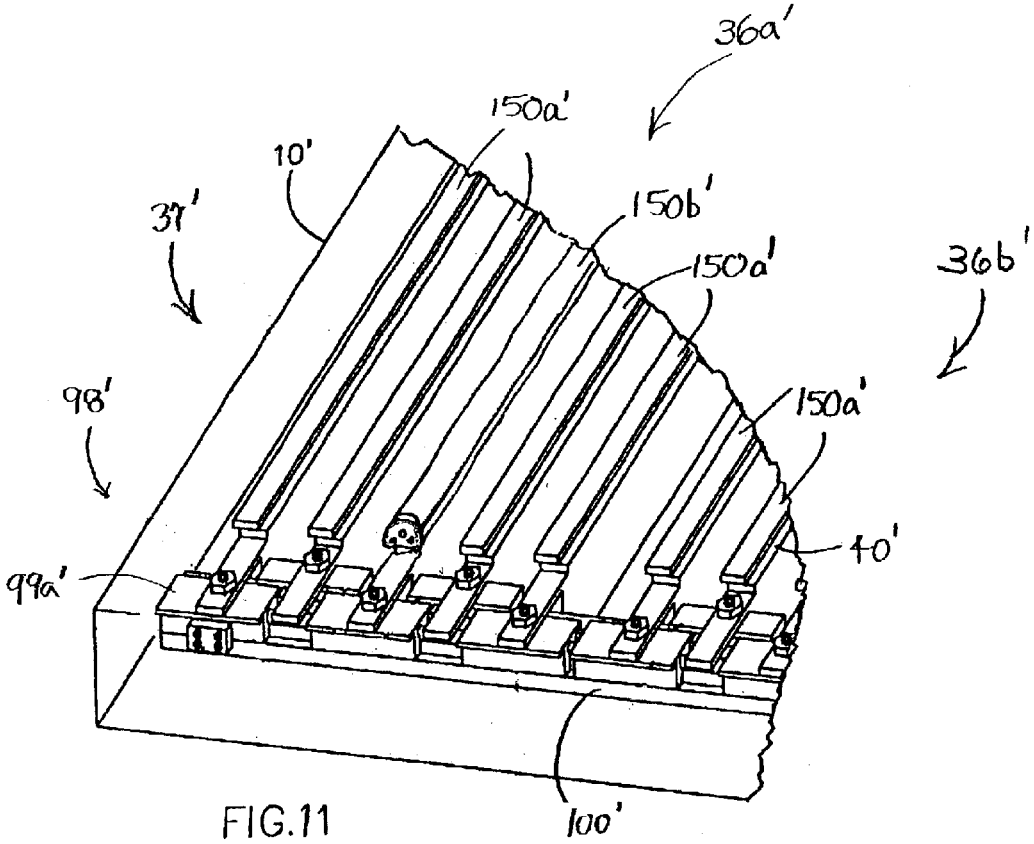
FIG. 11 is a perspective view of an embodiment of a variable frequency dewatering assembly according to the invention comprising dewatering elements in the form of foil beams and a table roll mounted on linear rails.

Referring now to FIG. 11, another embodiment of a variable frequency (VF) assembly 37' for dewatering in a papermaking apparatus is provided in accordance with the invention. The dewatering assembly 37' comprises multiple elements (devices) that function in a dewatering capacity. Such dewatering elements can include foil elements and table rolls, for example.

In the illustrated embodiment, the assembly 37' comprises two sets 36*a*', 36*b*' of dewatering elements 150*a*', 150*b*' supported on a rail system 98' affixed to a frame 100' of a Fourdrinier table 10' (shown in phantom), as described with reference to the embodiment illustrated in FIGS. 9A–9B, although other arrangements and actuators can be utilized. In the illustrated example, the dewatering elements 150*a*', 150*b*' are mounted on support beams mounted on rails 99*a*' of rail system 98', and attached to an actuating mechanism. The actuating mechanism is operable to laterally move the dewatering elements 150*a*', 150*b*' to space the elements apart by a standard interval, and to laterally move at least one of the sets 36*a*', 36*b*' to space apart the sets by an integer multiple of the standard interval.

Figure 12:
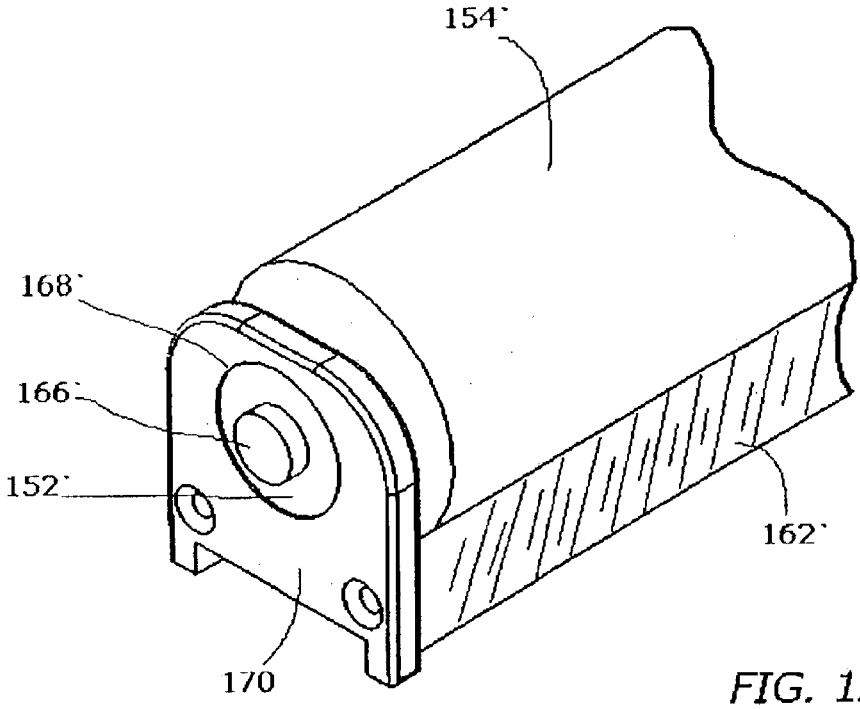
FIG. 12 is a perspective view of an embodiment of a table roll as used in the assembly in FIG. 11.
Figure 13:
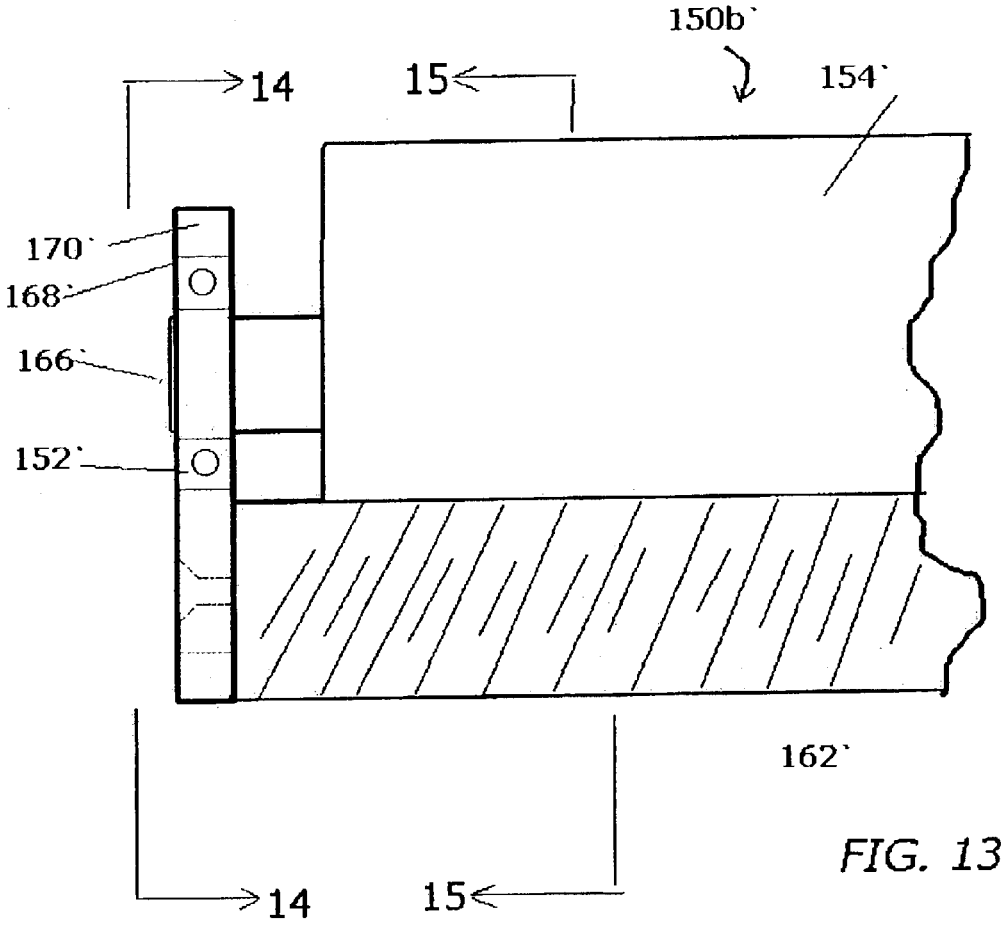
FIG. 13 is a partial side elevational view of the table roll of FIG. 12
Figure 14:
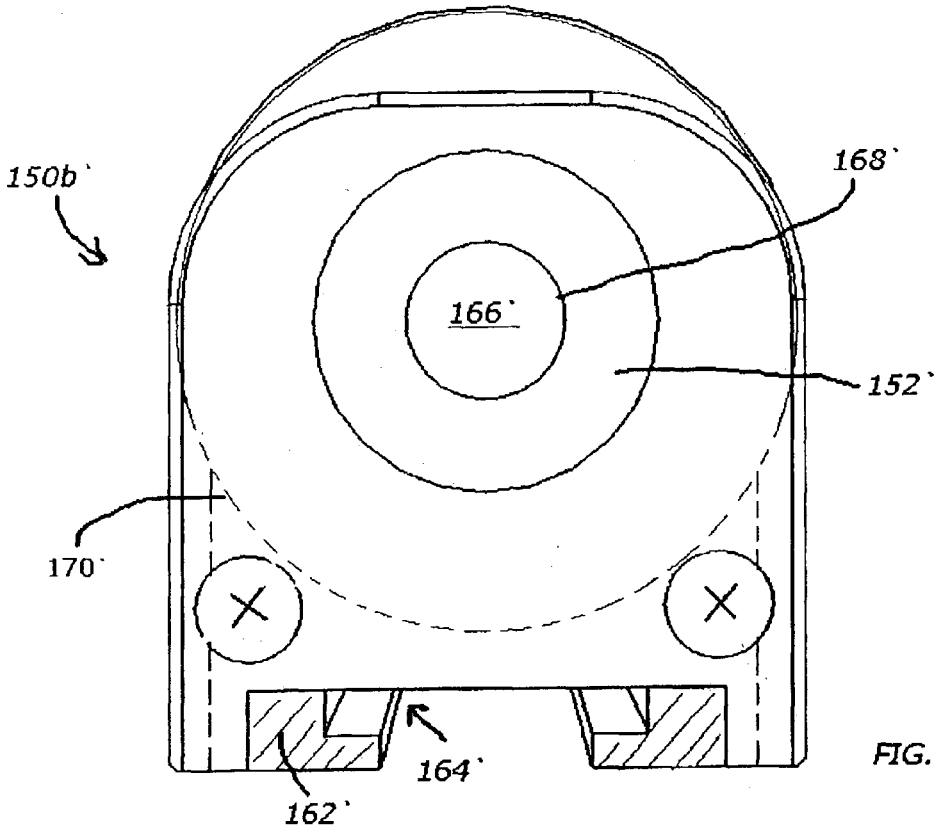
FIG. 14 is an end view of the table roll of FIG. 13, taken along line 14—14.
Figure 15:
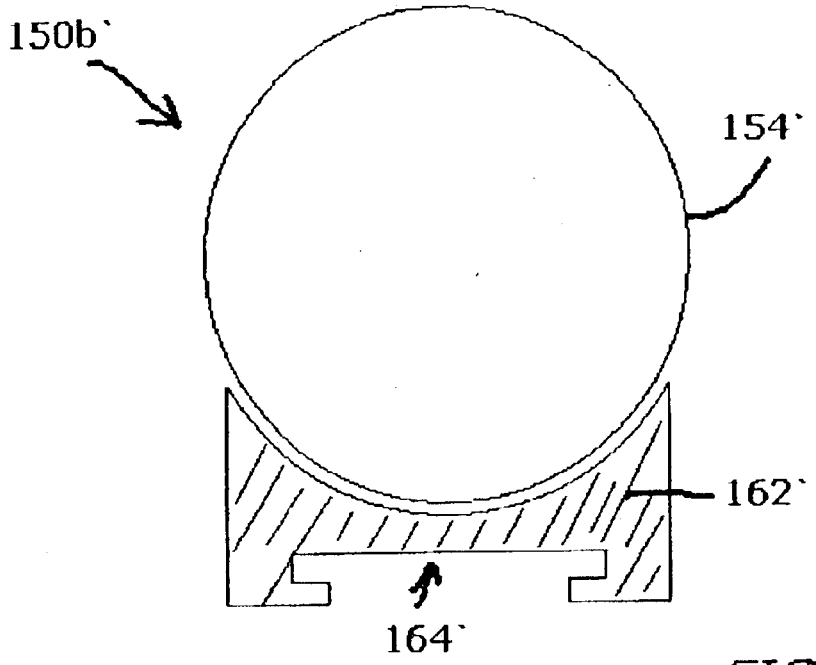
FIG. 15 is a cross-sectional view of the table roll of FIG. 13, taken along line 15—15.

In the present embodiment, the sets 36*a*', 36*b*' include dewatering elements in the form of one or more foil beams 150*a*' and one or more table rolls 150*b*'. An example of a table roll 150*b*' is illustrated in FIGS. 12–15. Referring to FIG. 12, a table roll 150*b*' is generally composed of a rubber cover cylinder 154' with stub ends 166' extending a significant distance from the cylinder ends to be supported by a radial bearings 152' in end bracket 170' permitting rotation of the cylinder. The base 162' serves as a support mechanism for the end brackets 170' and creates a scraper for water preventing its reintroduction in to the web. The diameter of cylinder 154' is generally about 2–3 inches.

The table roll 150*b*', like the foil beams 150*a*', is structured to be slidably mounted on a support beam. A typical support beam is in the form of a T-bar mount, although other configurations such as a dovetail mount, and the like, can also be utilized. As shown, the table roll 150*b*' includes a base 162' with a mating slot 162', shown as a T-shaped slot, running the full length of the base in the lower portion that is adapted for slidably mounting lengthwise onto the support beam mount. In the illustrated example, the table roll 150*b*' includes an extension member 166' such as a rotatable shaft or rod that is mounted through an opening 168' in an endplate 170' attached to the base 162'. The endplate 170' and base 162' are preferably fabricated from bronze, stainless steel or fiber reinforced plastic.

The inclusion of a table roll 150*b*' as a dewatering element in combination with foil elements (beams) 150*a*' in the VF assembly 37' is desirable to achieve the desired stock action in those circumstances in which a slower moving papermaking machine is used, for example. Another advantage is using foil beams and table roll(s) in combination is that at slower speeds, table rolls introduce energy into the stock.

Figure 16:
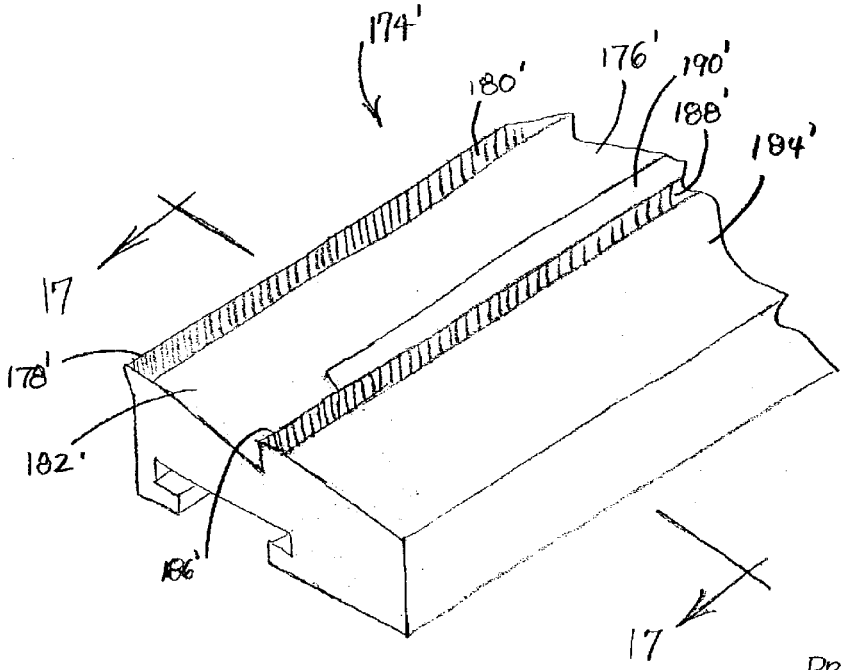
FIG. 16 PRIOR ART
FIG. 16 is a partial perspective view of an embodiment of a multi-surfaced foil element according to the invention.
Figure 17:
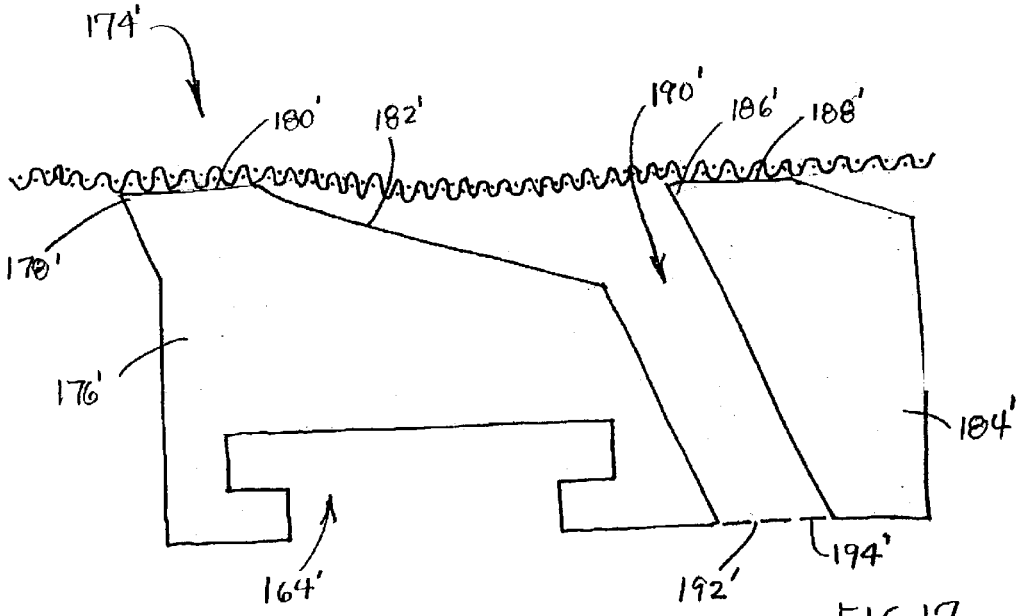
FIG. 17 PRIOR ART
FIG. 17 is a cross-sectional view of the foil element of FIG. 16 taken along line 17—17, showing a moving wire in contact with the surfaces of the foil element.

Referring now to FIGS. 16–17, in another embodiment of a variable frequency (VF) foil assembly according to the invention, foil elements 174' that have a multi-surface foil blade are utilized in the assembly. Foil elements, as illustrated in FIG. 9A, for example, typically have a front edge, a flat leading surface for bearing the wire, and a trailing surface angled at between 0° and 5° for draining water from the wire. The front edge meets the wire with an acute angle which sheers off water hanging under the wire. Typically, the minimum distance X that can be achieved by moving the individual foil beams within a set is an about 2½ inch pitch. However, there are applications for which a lower pitch is desirable.

In the present embodiment, the assembly incorporates one or more drainage foils 174' that have two wire-contacting surfaces spaced a fixed distance apart with a suction-forming section and a drainage section therebetween. An example of a multi-surfaced drainage foil is described for example, in U.S. Pat. No. 4,123,322 (Hoult), the disclosure of which is incorporated by reference herein. In use, the top part of the foil 174' is positioned adjacent to a forming wire 14'. Referring to FIGS. 16–17, the foil 174' is a unitary structure that includes a suction-forming section 176' with a leading edge 178', a wire contacting surface 180' and a trailing suction-producing surface 182', and a trailing section with a leading edge 186' and a wire contacting surface 188'. A water drainage slot 190' is located between the suction-producing surface 182' and the leading edge 186' of the trailing section 184'. The slot 190' communicates with an array of holes 192' through which water drawn from the wire can be drained away. A web(s) or other support 194' connects the suction-forming section to the trailing section. The multi-surfaced foil element includes a mating slot 164', shown as T-shaped slot, running the full length of the foil in the lower portion, which cooperates with a mount on a support beam for sliding the foil lengthwise onto the support beam.

Figure 18:
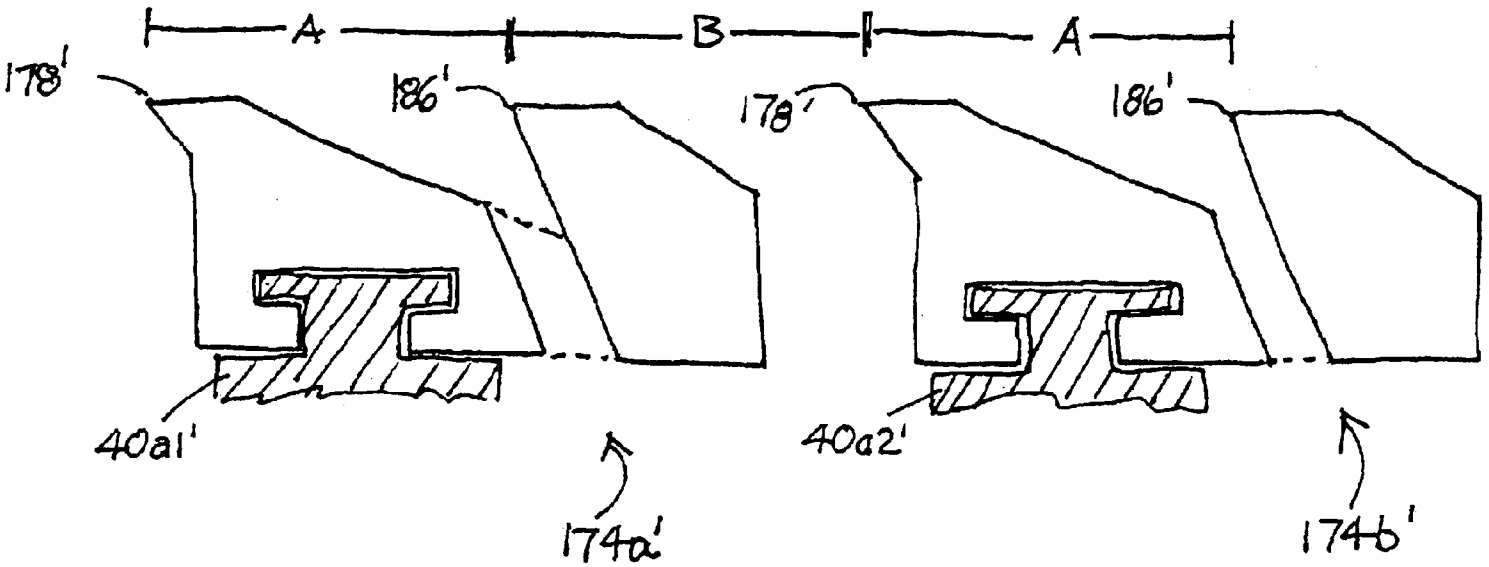
FIG. 18 is cross-sectional view of two multi-surfaced foil elements placed in an assembly.

According to the invention, the leading edge 186' of the trailing section 184' of the foil element 174' is positioned at a distance X from the leading edge 178' of the suction-forming section 176'. Referring to FIG. 18, the multi-sectioned foils 174' are placed in relation to each other such that the spacing A—A between the leading edges 178' and 186' of the multi-edged foil and the spacing B—B between the leading edge 178' of the leading foil **174*a*' and the leading edge 186' of the trailing foil 174*b*' are about equal. The construction of the multi-surface foil element 174'** is particularly useful in applications where a low pitch is desired, for example, a 2-inch pitch or lower such as a 1-1½ inch pitch.

In use in a variable frequency (VF) assembly according to the invention, for example, the assemblies shown in FIGS. 9A and 11, the two-surface foil element 174' can be slidably mounted onto a support beam 40' affixed onto a rail system 98' or other support, as described hereinabove, to provide two or more sets of foils. As described above, an actuator attached to each of the foil elements and to the foil sets, operates to laterally move the foil elements such that the contacting surfaces 180', 188' of the foil elements within a set are spaced apart by a standard interval X, and to laterally move at least one of the sets to space apart the sets by an integer multiple of the standard interval X, preferably so that the combined frequency of the foil sets is maintained at about 50 to about 90 hertz. With a multi-surfaced foil element 174' having an about 1-1½ inch pitch between contacting surfaces 180', 188, adjacent support beams 40' are typically spaced apart at about 3-inch intervals.

Figure 19:
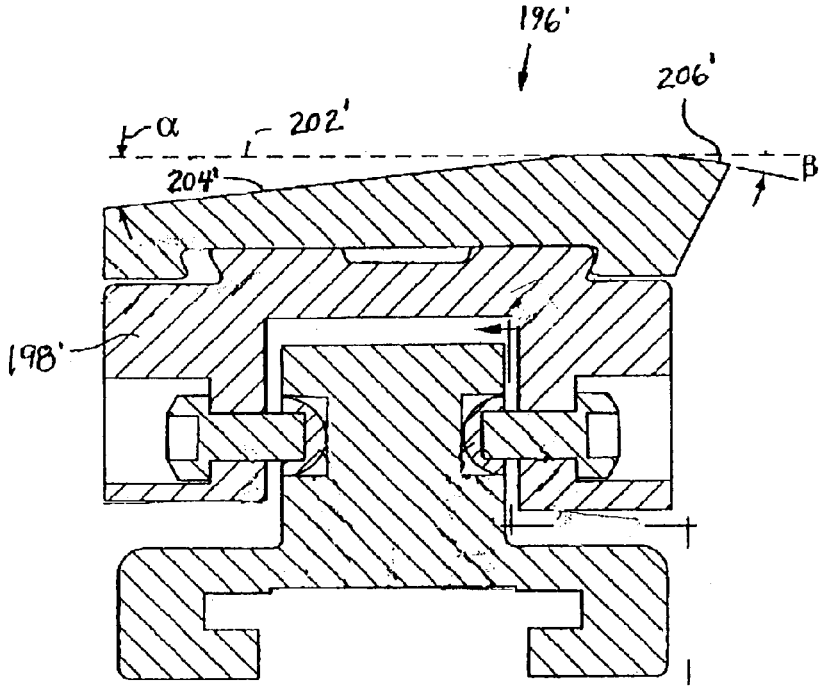
FIG. 19 PRIOR ART
FIG. 19 is a sectional view of an embodiment of a prior art adjustable angle foil.

Also useful according to the invention, is a VF assembly that incorporates one or more foil elements that are structured as an adjustable angle foil blade. The use of an adjustable angle foil allows the angle of the foil to be adjusted without removing the foil apparatus from the machine or stopping the machine. For example, FIG. 19 illustrates a prior art adjustable angle foil 196' described in U.S. Pat. No. 6,444,094 by Rulis (Wilbanks International, Inc.), the disclosure of which is incorporated by reference herein, in which the angle of the foil is adjusted by rocking or tipping the entire foil blade. The variable pulse turbulation blade 196' is mounted on a support base member 198', and includes a flat leading surface 200' adjacent the leading edge with an in-going angle (β) that is adjusted by a cam-operated adjustment mechanism (not shown) while maintaining the height of the blade relative to the conveyor 202' substantially constant. The foil angle (α) of the blade between its flat rear surface 204' and the conveyer 202', is also adjusted when the in-going angle (β) is adjusted.

Other examples of adjustable angle foils are described in U.S. Pat. No. 5,169,500 by Mejdell, and U.S. Pat. No. 6,274,002 by Rulis (both to Wilbanks International, Inc.), and U.S. Pat. No. 5,486,270 to Schiel (J.M. Voith GmbH, Heidenheim, Germany), the disclosures of which are incorporated by reference herein. Adjustable angle foils are also commercially available, for example, from IBS Paper Performance Group (Chesapeake, Va.), and CoorsTek (Hillsboro, Oreg.).

In use of the adjustable angle foil element 196', the foil element can be mounted on a beam support and onto a rail support to provide two or more foil sets, similar to the illustration in FIG. 9A, for example. An actuator attached to each of the foil elements and to the foil sets operates to laterally move the foil elements such that the contact surfaces of adjacent foil elements are distanced at a standard interval X and the foil sets are distanced at an integer multiple of X, in accordance with the invention.

The invention has been described by reference to detailed examples and methodologies. These examples are not meant to limit the scope of the invention. It should be understood that variations and modifications may be made while remaining within the spirit and scope of the invention, and the invention is not to be construed as limited to the specific embodiments shown in the drawings. The disclosures of the cited references throughout the application are incorporated by reference herein.

What is claimed is:

1. A foil beam assembly, comprising:

a plurality of foil beams, the foil beams comprising at least two sets of foil beams; and an actuating mechanism operable to move at least one of the foil beams of each set to space apart the foil beams of a set at a distance of a standard interval X, and to space apart adjacently situated foil beams of adjacent foil beam sets at a distance of about the standard interval X or an integer multiple of the standard interval of about 2X or greater.

2. The assembly of claim 1, wherein the actuating mechanism is connected to at least one of the foil beams of each set.

3. The assembly of claim 1, wherein at least one of the foil beams is affixed in a stationary position.

4. The assembly of claim 1, wherein the actuating mechanism comprises a worm gear assembly.

5. The assembly of claim 1, wherein the actuating mechanism comprises a telescoping shaft assembly.

6. A foil beam assembly, comprising:

a plurality of foil beams, the foil beams comprising at least two sets of foil beams; and an actuating mechanism operable to move at least one of the foil beams within each set to space apart the foil beams within a set at a distance of a standard interval and adjacent foil beams of adjacent foil beam sets at a distance of about the standard interval or an integer multiple of the standard interval of about 2X or greater.

7. A foil beam assembly, comprising:

a plurality of foil beams, the foil beams comprising at least two sets of foil beams; and an actuating mechanism operable to move one or more of the foil beams within each foil beam set to space apart each foil beam within a set and adjacently situated foil beams of adjacent foil beam sets at an about equidistant spacing.

8. A foil beam assembly, comprising:

at least two sets of foil beams, each set comprising at least two foil beams; and an actuating mechanism operable to move one or more of the foil beams within each foil beam set during a continuous operation of a papermaking apparatus whereby the foil beams of a set are spaced at an about equidistant spacing, and adjacently situated foil beams of adjacent foil beam sets are spaced apart at about said equidistant spacing or an integer multiple of said equidistant spacing of about 2X or greater.

9. A foil beam assembly, comprising:

at least two sets of foil beams, each set comprising at least two foil beams; and an actuating mechanism connected to one or more of the foil beams within each foil beam set and operable to move said foil beams to maintain a pitch distance of a standard interval between each foil beam within a set and a pitch distance of an integer multiple of the standard interval of about 2X or greater between adjacent foil beams of adjacent foil beam sets.

10. A foil beam assembly, comprising:

at least two sets of foil beams, each set comprising at least two foil beams; and an actuating mechanism connected to one or more of the foil beams within each foil beam set and operable to move said foil beams during a continuous operation of a papermaking apparatus to adjust the distance between the foil beams within a set and the distance between adjacent foil beam sets to vary a combined frequency of the foil beam sets.

11. The assembly of claim 10, wherein the actuating mechanism is operable to move the foil beams to maintain a combined frequency of the foil beam sets at about 50 to about 105 hertz.

12. The assembly of claim 10, wherein the actuating mechanism is operable to move the foil beams to maintain a combined frequency of the foil beam sets at about 50 to about 90 hertz.

13. A foil beam assembly, comprising:

a plurality of foil beams, the foil beams comprising at least two sets of foil beams; and an actuating mechanism operable to move one or more of the foil beams within each foil beam set;

wherein a distance between two adjacent foil beams within a set is at a standard interval, and a distance between two other adjacent foil beams within said set is at an integer multiple of the standard interval of about 2X or greater, and a distance between adjacently situated foil beams of adjacent foil beam sets is about the standard interval or an integer multiple of the standard interval of about 2X or greater.

14. A foil beam assembly, comprising:

a plurality of foil beams, the foil beams comprising at least two sets of foil beams, at least one foil beam being stationary and other of the foil beams being movable relative to the stationary foil beam; and an actuating mechanism operable to move at least one of the movable foil beams within each set to alter distance between the foil beams within a set and adjacently situated foil beams of adjacent foil beam sets.

15. A foil beam assembly, comprising:

a plurality of foil beams, the foil beams comprising at least two sets of foil beams, at least one foil beam being stationary and other of the foil beams being movable relative to the stationary foil beam; and an actuating mechanism operable to move at least one of the movable foil beams of each foil beam set during a continuous operation of a papermaking apparatus to vary distance between the foil beams and space apart the foil beams within a foil beam set at about a standard interval X and adjacently situated foil beams of adjacent foil beams sets at about the standard interval or an integer multiple of the standard interval of about 2X or greater.

16. A foil beam assembly, comprising:

two or more sets of foil beams, a first foil beam set comprising at least a leading foil beam and a trailing foil beam, the leading foil beam being stationary and the trailing foil beam being laterally moveable relative to the stationary leading foil beam, and the foil beams of other foil beam sets being moveable relative to the stationary leading foil beam of the first foil beam set; and an actuating mechanism operable to move at least one of the movable foil beams of each foil beam set during a continuous operation of a papermaking apparatus to vary distance between the foil beams and space apart the foil beams within a foil beam set at about a standard interval X and adjacent foil beams of adjacent foil beams sets at about the standard interval or an integer multiple of the standard interval of about 2X or greater.

17. A foil beam assembly, comprising:

a plurality of foil beams, at least one foil beam being stationary and other of the foil beams being moveable relative to each other and to the stationary foil beam, the moveable foil beams comprising at least two sets of foil beams;

an actuating mechanism operable to move at least one of the movable foil beams of each foil beam set to vary distance between said plurality of movable foil beams and space apart the foil beams within a foil beam set at about a standard interval X and adjacently situated foil beams of adjacent foil beams sets at about the standard interval or an integer multiple of the standard interval of about 2X or greater.

18. A foil beam assembly, comprising:

a plurality of foil beams, at least one foil beam being stationary and other of the foil beams being moveable relative to each other and to the stationary foil beam, the moveable foil beams comprising at least two sets of foil beams;

an actuating mechanism operable to move at least one of the movable foil beams of a foil beam set to vary distance between said plurality of movable foil beams and space apart the foil beams within a foil beam set at about a standard interval X, the stationary foil beam and adjacent foil beam at about the standard interval X, and adjacently situated foil beams of adjacent foil beams sets at about the standard interval X or an integer multiple of the standard interval of about 2X or greater.

19. A foil beam assembly, comprising:

a plurality of foil beams, at least one foil beam being affixed to a support in a stationary position and other of the foil beams being movable relative to the stationary foil beam, the moveable foil beams comprising at least two sets of foil beams; and an actuating mechanism connected to at least one of the movable foil beams of each foil beam set, the actuating mechanism operable to laterally move said foil beams during a continuous operation of a papermaking apparatus to space apart the foil beams at a distance of about a standard interval such that a combined frequency of the foil beam sets is maintained at about 50 to about 90 hertz during the operation of the papermaking apparatus.

20. A foil beam assembly, comprising:

two or more sets of foil beams, at least one foil beam being affixed to a support in a stationary position and other of the foil beams being movable relative to the stationary foil beam; and an actuating mechanism connected to at least one of the movable foil beams of each foil beam set, the actuating mechanism operable to laterally move said foil beams during a continuous operation of a papermaking apparatus to space apart the foil beams at a distance of about a standard interval and adjacently situated foil beams of adjacent foil beams sets at about the standard interval or an integer multiple of the standard interval of about 2X or greater such that a combined frequency of the foil beam sets is maintained at about 50 to about 90 hertz during the operation of the papermaking apparatus.

21. In a papermaking apparatus, a foil beam assembly comprising:

at least two sets of foil beams, each foil beam set comprising at least two foil beams; and an actuating mechanism operable to move one or more of the foil beams within each foil beam set;

wherein during operation of the papermaking apparatus, the actuating mechanism operates to move said foil beams to space apart each foil beam within a set at about an equidistant spacing of a standard interval and adjacently situated foil beams of adjacent foil beam sets at about the standard interval or an integer multiple of the standard interval of about 2X or greater.

22. The assembly of claim 21, wherein at least one foil beam is stationary and other of the foil beams are movable relative to the stationary foil beam.

23. A foil beam assembly, comprising:

a plurality of foil beams, the foil beams comprising at least two sets of foil beams;

an actuating mechanism operable to move at least one of the foil beams of each set to space apart the foil beams of a set at a distance of a standard interval X, and to space apart adjacently situated foil beams of adjacent foil beam sets at a distance of about the standard interval X or an integer multiple of the standard interval of about 2X or greater; and a mechanism for indicating the position of the beams relative to each other.

24. The assembly of claim 23, wherein the indicating mechanism is mounted on one or more of the foil beams.

25. The assembly of claim 23, wherein the indicating mechanism comprises a position feedback transducer.

26. The assembly of claim 23, wherein the indicating mechanism is integral to the actuating mechanism.

27. The assembly of claim 23, wherein the indicating mechanism is operable to communicate with a controller and receive a signal from the controller whereby the actuating mechanism is actuated to move the beams.

28. In a papermaking apparatus comprising a foil beam assembly, the assembly comprising a plurality of foil beams, the foil beams comprising at least two sets of foil beams;

a mechanism operable to alter a distance between the foil beams and to space apart the foil beams of a set at a distance of about a standard interval and to space apart adjacently situated foil beams of adjacent foil beam sets at a distance of about the standard interval or an integer multiple of the standard interval of about 2X or greater.

29. In a foil beam assembly comprising a plurality of foil beams, the foil beams comprising at least two sets of foil beams;

a mechanism for adjusting the frequency of the foil beam assembly, the mechanism connected to one or more of the foil beams within each foil beam set and operable to move said foil beams to alter a distance between the foil beams and maintain the foil beams of a foil beam set at a substantially equidistant spacing and adjacently situated foil beams of adjacent foil beam sets at about said equidistant spacing or an integer multiple of said equidistant spacing of about 2X or greater.

30. A method of varying the frequency of a foil beam assembly, comprising the steps of:

providing a foil beam assembly comprising a plurality of foil beams, the foil beams comprising at least two sets of foil beams; and an actuating mechanism operable to laterally move at least one of the foil beams of each set; and actuating the actuating mechanism to move said foil beams to alter a distance between the foil beams and space apart the foil beams of a set at a substantially equidistant spacing and adjacently situated foil beams of adjacent foil beam sets at about said equidistant spacing or an integer multiple of said equidistant spacing of about 2X or greater.

31. A foil assembly, comprising:

a plurality of foils; and an actuating mechanism operable to move at least one of the foils to space apart the foils at a distance of about a standard interval X or an integer multiple of the standard interval of about 2X or greater.

32. The assembly of claim 31, wherein the actuating mechanism is connected to at least one of the foils.

33. The assembly of claim 31, wherein at least one of the foil is affixed in a stationary position.

34. The assembly of claim 31, wherein the actuating mechanism comprises a worm gear assembly.

35. The assembly of claim 31, wherein the actuating mechanism comprises a telescoping shaft assembly.

36. The assembly of claim 31, further comprising a mechanism for indicating the position of the foils relative to each other.

37. The assembly of claim 36, wherein the indicating mechanism is connected to at least one of the foils.

38. The assembly of claim 36, wherein the indicating mechanism is connected to the actuating mechanism.

39. The assembly of claim 36, wherein the indicating mechanism is operable to communicate with a controller and receive a signal from the controller whereby the actuating mechanism is actuated to move the foils.

40. A foil assembly, comprising:

a plurality of foils; and an actuating mechanism operable to move at least one of the foils to space apart the foils at an about equidistant spacing.

41. A foil assembly, comprising:

a plurality of foils, at least one foil being stationary and other of the foils being movable relative to the stationary foil; and an actuating mechanism operable to move at least one of the moveable foils to space apart the foils at about a standard interval X or an integer multiple of the standard interval of about 2X or greater.

* * * * *